US006293858B1

(12) United States Patent
Kimura et al.

(10) Patent No.: US 6,293,858 B1
(45) **Date of Patent: *Sep. 25, 2001**

(54) POLISHING DEVICE

(75) Inventors: Norio Kimura; Toru Maruyama; Shunichiro Kojima; Seiji Katsuoka; Shin Ohwada, all of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/445,220

(22) PCT Filed: Apr. 5, 1999

(86) PCT No.: PCT/JP99/01788

§ 371 Date: Dec. 6, 1999

§ 102(e) Date: Dec. 6, 1999

(87) PCT Pub. No.: WO99/51397

PCT Pub. Date: Oct. 14, 1999

(30) Foreign Application Priority Data

Apr. 6, 1998 (JP) ..... 10-110142
Oct. 7, 1998 (JP) ..... 10-285744

(51) Int. Cl.[7] ..... B24B 5/00; B24B 29/00
(52) U.S. Cl. ..... 451/287; 451/398; 451/446
(58) Field of Search ..... 451/41, 60, 63, 451/285, 287, 288, 289, 397, 398, 446

(56) References Cited

U.S. PATENT DOCUMENTS 5,584,751 * 12/1996 Kobayashi et al. ..... 451/288
5,733,182 * 3/1998 Muramatsu et al. ..... 451/288
5,755,614 * 5/1998 Adams et al. ..... 451/60
5,885,134 * 3/1999 Shibata et al. ..... 451/60
5,931,725 * 8/1999 Inaba et al. ..... 451/288
6,024,630 * 2/2000 Shendon et al. ..... 451/288
6,109,868 * 2/2000 Kimura et al. ..... 451/288

FOREIGN PATENT DOCUMENTS 10-286769 10/1988 (JP) .
9-19863 1/1997 (JP) .
9-57612 3/1997 (JP) .
9-168964 6/1997 (JP) .
9-225821 9/1997 (JP) .

OTHER PUBLICATIONS

Pending U.S. Pat. application Ser. No. 09/056,617, filed Apr. 8, 1998, Norio Kimuraet al., entitled "Polishing Apparatus", located in Group Art Unit 1765.

Pending U.S. Pat. application Ser. No. 09/028,661, filed Feb. 24, 1998, Norio Kimura et al., entitled "Polishing Apparatus", located in Group Art Unit 1763 (Issue Fee Paid Apr. 30, 1999—Issue Batch No. 045).

* cited by examiner

*Primary Examiner*—Derris H. Banks
(74) *Attorney, Agent, or Firm*—Wenderoth, Lind & Ponack, L.L.P.

(57) ABSTRACT

A polishing apparatus for polishing a workpiece such as a semiconductor wafer to a flat mirror finish includes a turntable with a polishing cloth mounted on an upper surface thereof and a top ring for polishing a semiconductor wafer to a flat mirror finish by placing the semiconductor wafer between the turntable and the top ring and pressing the semiconductor wafer under a certain pressing force. A presser ring is vertically movably provided around the top ring. A pressing device presses the presser ring against the polishing cloth under a variable pressing force, and the presser ring is supported by the top ring through a bearing.

20 Claims, 13 Drawing Sheets

POLISHING DEVICE

TECHNICAL FIELD

The present invention relates to a polishing apparatus for polishing a workpiece such as a semiconductor wafer to a flat mirror finish, and more particularly to a polishing apparatus having a mechanism which can control the amount of a material removed from a peripheral portion of the workpiece.

BACKGROUND ART

Recent rapid progress in semiconductor device integration demands smaller and smaller wiring patterns or interconnections and also narrower spaces between interconnections. In case of photolithography which can form interconnections that are at most 0.5 $\mu$m wide, it requires that surfaces of semiconductor wafers on which pattern images are to be focused by a stepper be as flat as possible because the depth of focus of the optical system is relatively small. As a means for planarizing the semiconductor wafer, it is polished by a polishing apparatus.

Conventionally, this kind of polishing apparatus has a turntable and a top ring, and the top ring applies a certain pressure to the turntable. The workpiece to be polished is placed between the top ring and the turntable, and while supplying an abrasive liquid, the workpiece is polished to a flat mirror finish.

In the polishing apparatus described above, if the workpiece is not pressed against the polishing cloth under forces which are uniform over the entire surface of the workpiece, then the workpiece tends to be polished insufficiently or excessively in local areas depending on the applied forces. Therefore, in the conventional polishing apparatus, as a means for preventing nonuniform pressing forces, the following arrangements have been proposed.

① An elastic pad of polyurethane or the like is applied to a wafer holding surface of the top ring for uniformizing a pressing force applied from the top ring to the semiconductor wafer.

② A workpiece carrier for holding the workpiece, i.e. the top ring, is tiltable with respect to the surface of the polishing cloth.

③ A region of the polishing cloth surrounding the workpiece is pressed independently of the top ring and the workpiece, for thereby eliminating an appreciable step between a region of the polishing cloth pressed by the workpiece and the surrounding region thereof.

FIG. 12 of the accompanying drawings shows a main part of a conventional polishing apparatus. The conventional polishing apparatus comprises a turntable 41 with a polishing cloth 42 attached to an upper surface thereof, a top ring 45 for holding a semiconductor wafer 43 to allow the semiconductor wafer 43 to be rotated and to be pressed, and an abrasive liquid supply nozzle 48 for supplying an abrasive liquid Q to the polishing cloth 42. The top ring 45 is connected to a top ring shaft 49, and is provided with an elastic pad 47 of polyurethane or the like on its lower surface. The semiconductor wafer 43 is held by the top ring 45 in contact with the elastic pad 47. The top ring 45 also has a cylindrical guide ring 46A on an outer circumferential edge thereof for retaining the semiconductor wafer 43 on the lower surface of the top ring 45. Specifically, the guide ring 46A is fixed to the top ring 45, and has a lower end projecting downwardly from the lower surface of the top ring 45 for holding the semiconductor wafer 43 on the elastic pad 47 to prevent removal of the top ring 45 under frictional engagement with the polishing cloth 42 during a polishing process.

In operation, the semiconductor wafer 43 is held against the lower surface of the elastic pad 47 which is attached to the lower surface of the top ring 45. The semiconductor wafer 43 is then pressed against the polishing cloth 42 on the turntable 41 by the top ring 45, and the turntable 41 and the top ring 45 are rotated to move the polishing cloth 42 and the semiconductor wafer 43 relatively to each other, thereby polishing the semiconductor wafer 43. At this time, the abrasive liquid Q is supplied onto the polishing cloth 42 from the abrasive liquid supply nozzle 48. The abrasive liquid Q comprises an alkaline solution containing an abrasive grain of fine particles suspended therein, for example. The semiconductor wafer 43 is polished by a composite action comprising a chemical polishing action of the alkaline solution and a mechanical polishing action of the abrasive grain.

FIG. 13 of the accompanying drawings shows in an enlarged fragmentary cross-section the semiconductor wafer, the polishing cloth and the elastic pad during polishing by the polishing apparatus shown in FIG. 12. As shown in FIG. 13, in case of such structure in which only the workpiece presses the polishing cloth, the workpiece, i.e. the semiconductor wafer 43, has a peripheral portion which is a boundary between contact and noncontact with the polishing cloth 42 and also is a boundary between contact and noncontact with the elastic pad 47. At the peripheral portion of the workpiece, the polishing pressure applied to the workpiece by the polishing cloth and the elastic pad is not uniform, and thus the peripheral portion of the workpiece is liable to be polished to an excessive degree. As a result, the peripheral edge of the workpiece is often polished into a so-called edge-rounding.

In order to prevent the peripheral portion of the semiconductor wafer from being excessively polished, there has been proposed in Japanese patent application No. 9-105252 a polishing apparatus having a structure for pressing an area of the polishing cloth which is located around the peripheral portion of the semiconductor wafer.

FIG. 14 of the accompanying drawings shows the polishing apparatus disclosed in Japanese patent application No. 9-105252. In FIG. 14, the reference numeral 51 represents a top ring which comprises a top ring body 51A and a retainer ring 51B removably fixed to the peripheral portion of the top ring body 51A by bolts 181. A recess 51*a* for accommodating a semiconductor wafer 54 is formed by a lower surface of the top ring body 51A and the retainer ring 51B. The semiconductor wafer 54 has an upper surface held by the lower surface of the top ring body 51A, and an outer peripheral edge held by the retainer ring 51B. A presser ring 53 is vertically movably disposed around the top ring body 51A and the retainer ring 51B. A leaf spring 67 having a U-shaped cross-section is provided between the presser ring 53 and the top ring 51 to prevent a direct contact of the presser ring 53 and the top ring 51 and to suppress excessive tilting of the top ring 51.

An elastic pad 52 is attached to a lower surface of the top ring 51. A turntable 55 having a polishing cloth 56 attached thereto is disposed below the top ring 51. An attachment flange 182 having a spherical concave surface 182*a* is fixed to the top ring body 51A. A top ring shaft 58 is disposed above the top ring 51. A drive shaft flange 184 having a spherical concave surface 184*a* is fixed to the lower end of the top ring shaft 58. A spherical bearing 57 is disposed between the spherical concave surfaces 182*a* and 184*a*. A space 183 is formed between the top ring body 51A and the attachment flange 182, and vacuum, pressurized air, and liquid such as water can be supplied to the space 183.

The top ring shaft 58 is coupled to a top ring air cylinder (not shown) fixed to a top ring head 59. The top ring shaft 58 is vertically movable by the top ring air cylinder, and the semiconductor wafer 54 held by the lower end surface of the top ring 51 is pressed against the polishing cloth 56 on the turntable 55. Further, the top ring shaft 58 is coupled to a top ring motor (not shown), and the top ring 51 is rotated by the top ring motor. The presser ring 53 provided around the top ring 51 is coupled at its upper end to presser ring air cylinders 72. The presser ring air cylinders 72 are fixed to the top ring head 59. A plurality of (e.g. three) the presser ring air cylinders 72 are circumferentially spacedly provided. There is no means such as a key between the top ring 51 and the presser ring 53 for transmitting the rotation of the top ring 51 to the presser ring 53. Therefore, the top ring 51 is rotated about an axis of the top ring shaft 58 during polishing, but the presser ring 53 is nonrotatable about its own axis.

The top ring air cylinder and the presser ring air cylinders 72 are connected to a compressed air source (not shown) through respective regulators (not shown). By adjusting the pressing force of the presser ring with respect to the pressing force of the top ring, the distribution of polishing pressures is made continuous and uniform from the center of the semiconductor wafer to its peripheral edge and further to the outer circumferential edge of the presser ring disposed around the semiconductor wafer. Consequently, the peripheral portion of the semiconductor wafer is prevented from being polished excessively or insufficiently.

In the polishing apparatus proposed in Japanese patent application No. 9-105252, the presser ring 53 is supported only by the shafts of the air cylinders 72 fixed to the top ring head 59. Although plural of (e.g. three) the air cylinders 72 are disposed circumferentially at equal intervals, the presser ring 53 is supported by a so-called cantilever structure in which the presser ring 53 relies only on rigidity of the shafts of the air cylinders. Because a large frictional torque is applied to the lower surface of the presser ring 53, the presser ring 53 cannot be highly rigidly, i.e. reliably, supported. Thus, it is difficult to ensure the concentricity of the top ring and the presser ring, and the presser ring is eccentrically positioned with respect to the top ring. Consequently, the full circumferential area of the polishing cloth around the peripheral portion of the semiconductor wafer cannot be uniformly pressed, and polishing effect of the peripheral portion of the semiconductor wafer is adversely affected.

Further, the leaf spring 67 is disposed between the top ring 51 and the presser ring 53 to prevent a direct contact of the top ring 51 and the presser ring 53 and to suppress excessive tilting of the top ring 51. However, as described above, the rigidity of the structure for supporting the presser ring 53 is insufficient, and hence the leaf spring 67 is rapidly worn out and the frequency of replacement of the leaf spring 67 is high.

Furthermore, since the presser ring 53 surrounds the full circumference of the top ring 51 and presses the polishing cloth 56 downwardly during polishing of the semiconductor wafer which is a workpiece, the presser ring 53 prevents the slurry-like abrasive liquid supplied to the surface of the polishing cloth 56 from entering the inside of the presser ring 53. As a result, the abrasive liquid which is located between the polishing cloth and the workpiece and is actually used for polishing is insufficient in quantity.

DISCLOSURE OF INVENTION

It is therefore a first object of the present invention to provide a polishing apparatus in which a presser ring is highly rigidly, i.e. sufficiently reliably, supported and the concentricity of the presser ring and the top ring can be ensured accurately.

It is a second object of the present invention to provide a polishing apparatus which can prevent an abrasive liquid which is located between the polishing cloth and the workpiece and is actually used for polishing from being insufficient in quantity.

In order to achieve the first object, according to the first aspect of the present invention, there is provided a polishing apparatus having a turntable with a polishing cloth mounted on an upper surface thereof and a top ring for polishing a workpiece to a flat mirror finish by placing the workpiece between the turntable and the top ring and pressing the workpiece under a certain pressing force, characterized in that a presser ring is vertically movably provided around the top ring having a recess for accommodating the workpiece, pressing means is provided for pressing the presser ring against the polishing cloth under a variable pressing force, and the presser ring is supported by the top ring through a bearing.

According to the present invention, since the presser ring is supported by the top ring through the bearing, the presser ring can be highly rigidly, i.e. sufficiently reliably, supported, and the concentricity of the top ring and the presser ring can be ensured.

In order to achieve the second object of the present invention, according to the second aspect of the present invention, there is provided a polishing apparatus having a turntable with a polishing cloth mounted on an upper surface thereof and a top ring for polishing a workpiece to a flat mirror finish by placing the workpiece between the turntable and the top ring and pressing the workpiece under acertain pressing force, characterized in that a presser ring is vertically movably provided around the top ring having a recess for accommodating the workpiece, pressing means is provided for pressing the presser ring against the polishing cloth under a variable pressing force, and abrasive liquid supply means for supplying an abrasive liquid to the inside of the presser ring is provided.

According to the present invention, since means for supplying the abrasive liquid to the inside of the presser ring is provided, even if the supply of the slurry-like abrasive liquid to the inside of the presser ring is interrupted by the presser ring during polishing of the semiconductor wafer, insufficient supply of the abrasive liquid which is used for polishing can be prevented by directly supplying the abrasive liquid to the inside of the presser ring. Therefore, the workpiece can be smoothly polished under the sufficient amount of the abrasive liquid.

BEST MODE FOR CARRYING OUT THE INVENTION

Figure 1:
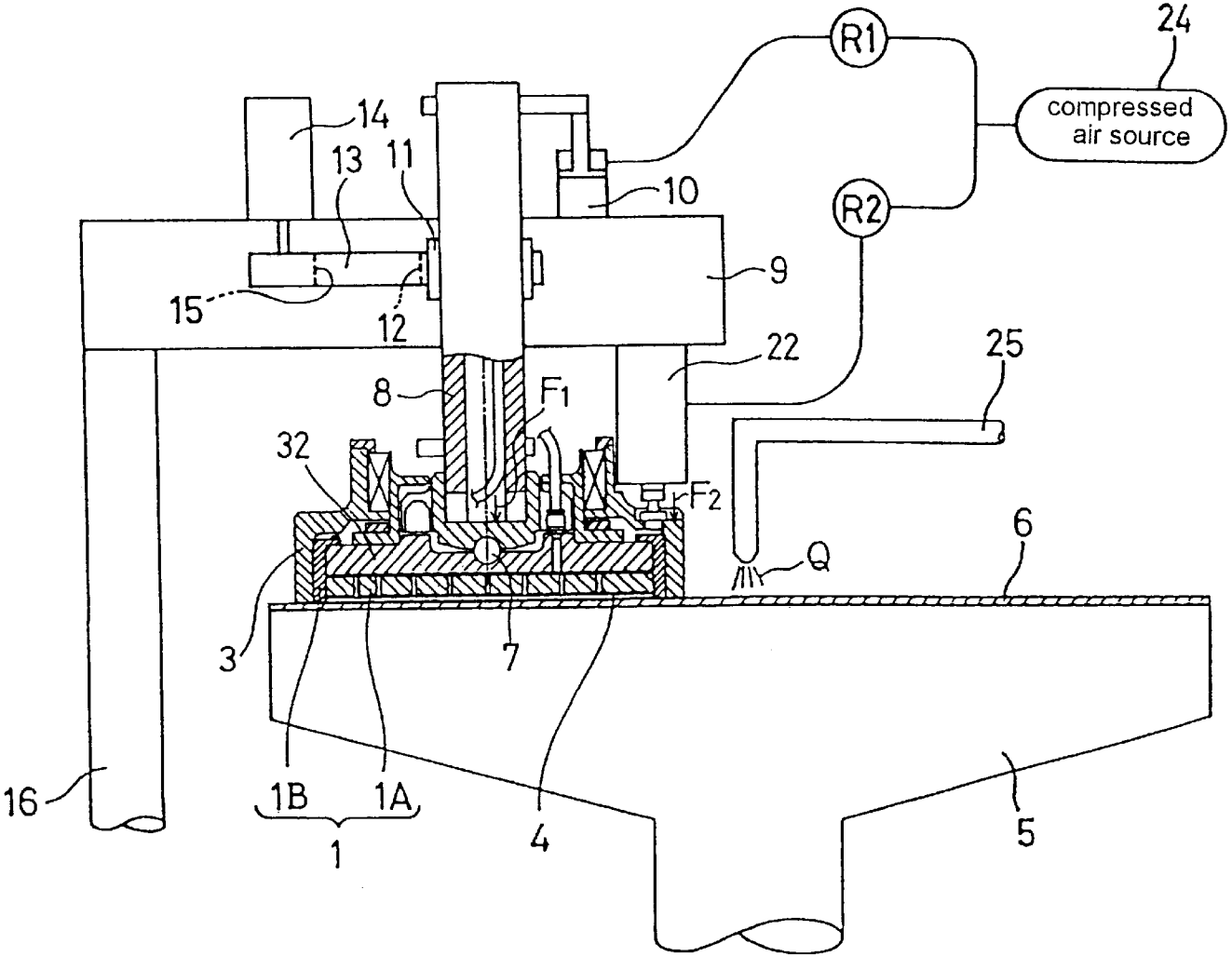
FIG. 1 is a cross-sectional view of a polishing apparatus according to a first embodiment of the present invention.
Figure 2:
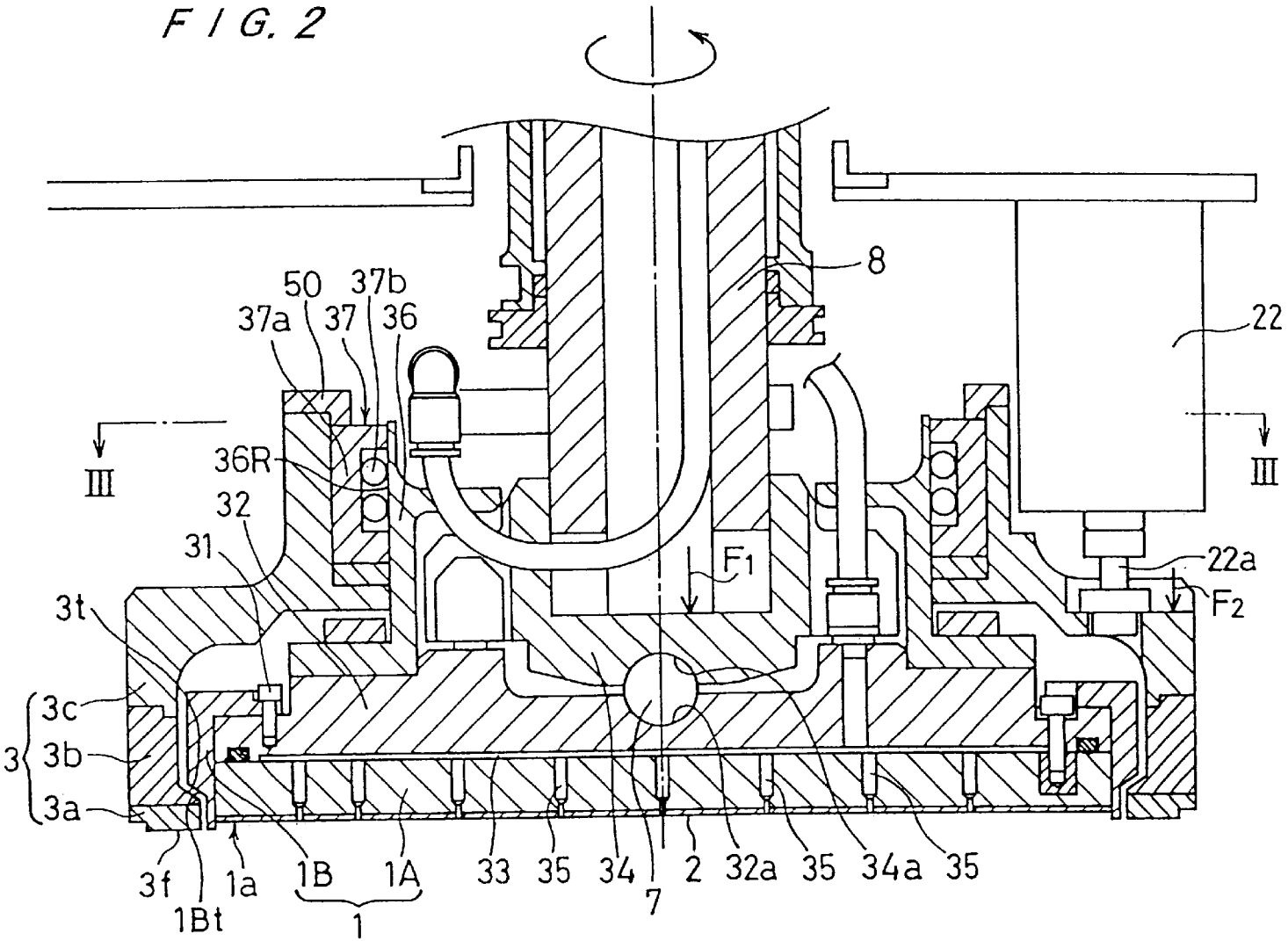
FIG. 2 is an enlarged fragmentary cross-sectional view of the polishing apparatus in the first embodiment.
Figure 3:
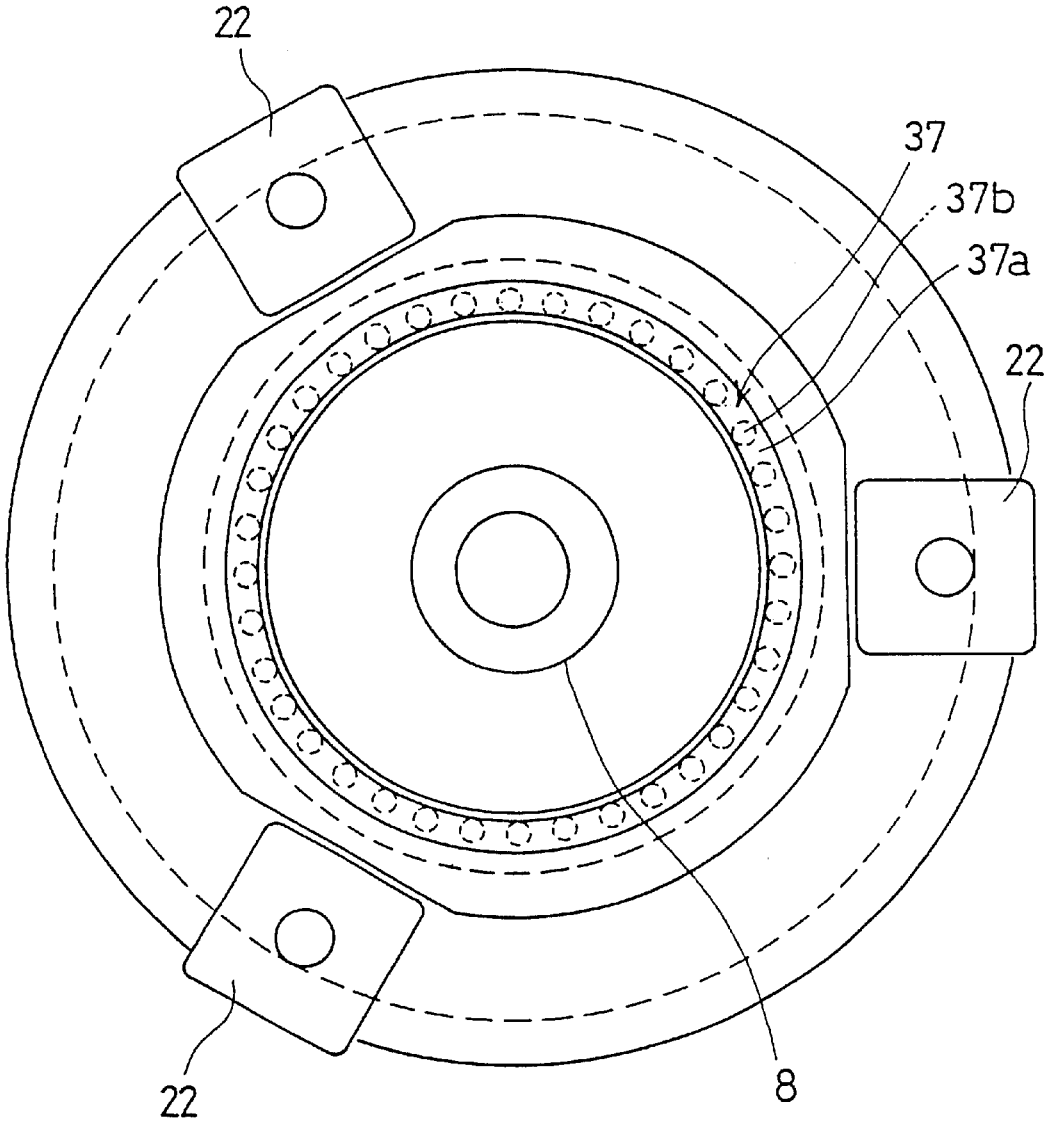
FIG. 3 is a view as viewed from line III—III of FIG. 2.

Next, a polishing apparatus according to embodiments of the present invention will be described below with reference to the drawings. FIGS. 1 through 3 are views showing a polishing apparatus according to a first embodiment of the present invention. FIG. 1 is a cross-sectional view of a whole structure of a polishing apparatus, FIG. 2 is an enlarged cross-sectional view of a top ring and a presser ring, and FIG. 3 is a view as viewed from line III—III of FIG. 2.

In FIGS. 1 and 2, the reference numeral 1 represents a top ring comprising a top ring body 1A and a retainer ring 1B detachably fixed to an outer circumferential edge of the top ring body 1A by bolts 31. A recess 1*a* for accommodating a semiconductor wafer 4 therein is defined jointly by a lower surface of the top ring body 1A and an inner circumferential surface of the retainer ring 1B. The upper surface of the semiconductor wafer 4 is held by the lower surface of the top ring body 1A and an outer circumferential edge of the semiconductor wafer 4 is held by the inner circumferential surface of the retainer ring 1B. A presser ring 3 is vertically movably disposed around the retainer ring 1B.

The top ring 1 includes an elastic pad 2 attached to the lower surface of the top ring 1. The polishing apparatus also has a turntable 5 disposed below the top ring 1, and a polishing cloth 6 attached to an upper surface of the turntable 5. An attachment flange 32 having a spherical concave surface 32*a* defined in an upper surface thereof is fixedly mounted on the top ring body 1A. A top ring shaft 8 is disposed above the top ring 1, and a drive shaft flange 34 having a spherical concave surface 34*a* is fixedly mounted on the lower end of the top ring shaft 8. A spherical bearing 7 is disposed between the spherical concave surfaces 32*a* and 34*a*. The top ring body 1A and the attachment flange 32 jointly define a space 33 therebetween which can be supplied with a vacuum, a compressed air, and a liquid such as water. The top ring body 1A has a plurality of vertical communication holes 35 defined therein which communicate with the space 33 and are open at the lower surface of the top ring body 1A. The elastic pad 2 also has a plurality of openings which are in communication with the respective communication holes 35. Therefore, the upper surface of the semiconductor wafer 4 (see FIG. 1) can be attracted to the top ring body 1A under vacuum developed in the space 33. Further, the upper surface of the semiconductor wafer 4 can be supplied with a liquid or a compressed air from the space 33.

The top ring shaft 8 is rotatably supported by a top ring head 9 and operatively coupled to a top ring air cylinder 10 fixedly mounted on the top ring head 9. The top ring shaft 8 is vertically movable by the top ring air cylinder 10 for pressing the semiconductor wafer 4 held by the top ring 1 against the turntable 5. The top ring shaft 8 is connected through a key (not shown) to a rotatable sleeve 11. The rotatable sleeve 11 has a timing pulley 12 mounted on its outer circumferential surface and operatively connected through a timing belt 13 to a timing pulley 15 mounted on a top ring motor 14 that is fixedly mounted on the top ring head 9. Therefore, when the top ring motor 14 is energized, the sleeve 11 and the top ring shaft 8 are rotated in unison with each other through the timing pulley 15, the timing belt 13, and the timing pulley 12 to thereby rotate the top ring 1. The top ring head 9 is supported on an upper end of a vertical top ring head shaft 16 fixedly supported on a frame (not shown).

As shown in FIG. 2, the presser ring 3 disposed around the top ring 1 comprises a vertical stack of presser ring members including a first presser ring member 3*a* made of alumina ceramics and disposed at a lowermost position, and second and third presser ring members 3*b*, 3*c* made of stainless steel and disposed upwardly of the first presser ring member 3*a*. The second and third presser ring members 3*b* and 3*c* are interconnected by bolts (not shown), and the first presser ring member 3*a* is fixed to the second presser ring member 3*b* by adhesion or the like. The first presser ring member 3*a* has a pressing surface 3*f* on its lower end for pressing the polishing cloth 6.

A bearing receiving flange 36 is fixed to the attachment flange 32 of the top ring 1. A presser ring support bearing 37 is provided between the bearing receiving flange 36 and the presser ring 3 for supporting the presser ring 3. As shown in FIGS. 2 and 3, the presser ring support bearing 37 comprises a bearing case 37*a* fitted in the third presser ring member 3*c*, a number of balls 37*b* disposed fully circumferentially in upper and lower rows, and a retainer (not shown) disposed in the bearing case 37*a* for retaining the balls 37 therein. The upper end of the presser ring support bearing 37 engages with a bearing retainer 50 fixed to the upper end of the presser ring 3 to allow the presser ring support bearing 37 to be fixed.

In this embodiment, there is no means such as a key between the top ring 1 and the presser ring 3 for transmitting the rotation of the top ring 1 to the presser ring 3. Therefore, the top ring 1 rotates about an axis of the top ring shaft 8 during polishing, but the presser ring 3 is nonrotatable about its own axis. That is, relative rotation is made between the top ring 1 and the presser ring 3. At this time, the outer circumferential surface of the bearing receiving flange 36 fixed to the top ring 1 constitutes a ball rolling surface 36R along which the balls 37*b* roll. The presser ring support bearing 37 has both functions of a rotation support bearing and a vertical movement support bearing, and the top ring 1 and the presser ring 3 are allowed to rotate relatively to each other by the rotation support bearing function of the presser ring support bearing 37, and the presser ring 3 is allowed to move vertically with respect to the top ring 1 by the vertical movement support bearing function.

The presser ring air cylinders 22 have respective shafts 22*a* whose lower ends engage with the third presser ring 3*c* of the presser ring 3. The presser ring air cylinders 22 are fixedly connected to the top ring head 9. A plurality of (e.g. three) the presser ring air cylinders 22 are circumferentially disposed at intervals. The retainer ring 1B is made of a metal such as stainless steel, and has on its outer circumference a tapered surface 1Bt that is inclined radially inwardly in a downward direction, so that the retainer ring 1B has a thin wall portion thinner than the portion of the retainer ring 1B above the lower end of the tapered surface 1Bt. The presser ring 3 has on its inner circumference a tapered surface 3*t* that is inclined radially inwardly in a downward direction complementarily to the tapered surface 1Bt of the retainer ring 1B to thereby allow the pressing surface 3*f* to be positioned as closely as possible to the outer circumferential edge of the semiconductor wafer 4 which is held by the top ring 1.

Because the distance between the inner circumferential edge of the pressing surface 3*f* and the outer circumferential edge of the semiconductor wafer 4 is minimized by the above structure of the retainer ring 1B and the presser ring 3, the presser ring 3 can press the polishing cloth 6 downwardly near the outer circumferential edge of the semiconductor wafer 4.

As shown in FIG. 1, the top ring air cylinder 10 and the presser ring air cylinders 22 are connected to a compressed air source 24 through respective regulators R1 and R2. The regulator R1 regulates the air pressure supplied from the compressed air source 24 to the top ring air cylinder 10 to adjust the pressing force of the top ring 1 which presses the semiconductor wafer 4 against the polishing cloth 6. The regulator R2 regulates the air pressure supplied from the compressed air source 24 to the presser ring air cylinders 22 to adjust the pressing force of the presser ring 3 which presses the polishing cloth 6.

An abrasive liquid supply nozzle 25 is disposed above the turntable 5 for supplying an abrasive liquid Q to the polishing cloth 6.

In the polishing apparatus having the above structure, the semiconductor wafer 4 is held by the lower surface of the top ring 1, and the top ring air cylinder 10 is operated to press the top ring 1 downwardly toward the turntable 5 for thereby pressing the semiconductor wafer 4 against the polishing cloth 6 on the turntable 5 which is rotating. On the other hand, the abrasive liquid Q is supplied from the abrasive liquid supply nozzle 25 onto the polishing cloth 6 and is retained thereon. The surface to be polished (the lower surface) of the semiconductor wafer 4 is polished by the abrasive liquid Q which is present between the lower surface of the semiconductor wafer 4 and the polishing cloth 6.

Depending on the force applied from the top ring air cylinder 10 to the top ring 1, the pressing force of the presser ring 3 for pressing the polishing cloth 6 by the presser ring air cylinders 22 is adjusted properly for thereby polishing the semiconductor wafer 4. While the semiconductor wafer 4 is being polished, the pressing force $F_1$ which is applied by the top ring 1 to press the semiconductor wafer 4 against the polishing cloth 6 can be changed by the regulator R1, and the pressing force $F_2$ which is applied by the presser ring 3 to press the polishing cloth 6 can be changed by the regulator R2 (see FIG. 1). Therefore, during the polishing process, the pressing force $F_2$ applied by the presser ring 3 to press the polishing cloth 6 can be changed depending on the pressing force $F_1$ applied by the top ring 1 to press the semiconductor wafer 4 against the polishing cloth 6. By adjusting the pressing force $F_2$ with respect to the pressing force $F_1$, the distribution of polishing pressures is made continuous and uniform from the center of the semiconductor wafer 4 to its peripheral edge and further to the outer circumferential edge of the presser ring 3 disposed around the semiconductor wafer 4. Consequently, the peripheral portion of the semiconductor wafer 4 is prevented from being polished excessively or insufficiently.

If a greater or smaller thickness of material is to be removed from the peripheral portion of the semiconductor wafer 4 than from the inner region of the semiconductor wafer 4, then the pressing force $F_2$ applied by the presser ring 3 is selected to be of a suitable value based on the pressing force $F_1$ applied by the top ring 1 to intentionally increase or reduce the amount of a material removed from the peripheral portion of the semiconductor wafer 4.

In the illustrated embodiment, since the presser ring 3 is supported by the top ring 1 through the presser ring support bearing 37, the presser ring 3 is highly rigidly, i.e. sufficiently reliably, supported. Further, the presser ring 3 is allowed to move vertically with respect to the top ring 1 by the vertical movement support bearing function of the presser ring support bearing 37, and hence the presser ring 3 is vertically moved under a small sliding resistance and in a smooth condition.

Further, since the presser ring 3 is supported by the presser ring support bearing 37 disposed coaxially with the top ring 1, the concentricity of the presser ring 3 and the top ring 1 can be ensured highly accurately. As a result, the gap between the presser ring 3 and the top ring 1, and thus the gap between the inner circumferential edge of the presser ring 3 and the outer circumferential edge of the semiconductor wafer 4 held by the top ring 1 can be kept constant in a full circumference thereof. This allows the gap between the inner circumferential edge of the presser ring 3 and the outer circumferential edge of the semiconductor wafer 4 held by the top ring 1 to be smaller than that of the conventional structure in which the retainer ring and the presser ring have only respective tapered surfaces, and the stability of performance and the ease of controllability can be achieved. Specifically, since the semiconductor wafer can be polished uniformly as closely as possible to the outer circumferential edge of the semiconductor wafer 4, the number of semiconductor device products obtained from one semiconductor wafer increases, and the responsiveness in response to change of operational conditions such as pressing forces of the presser ring during polishing is improved.

Figure 14:
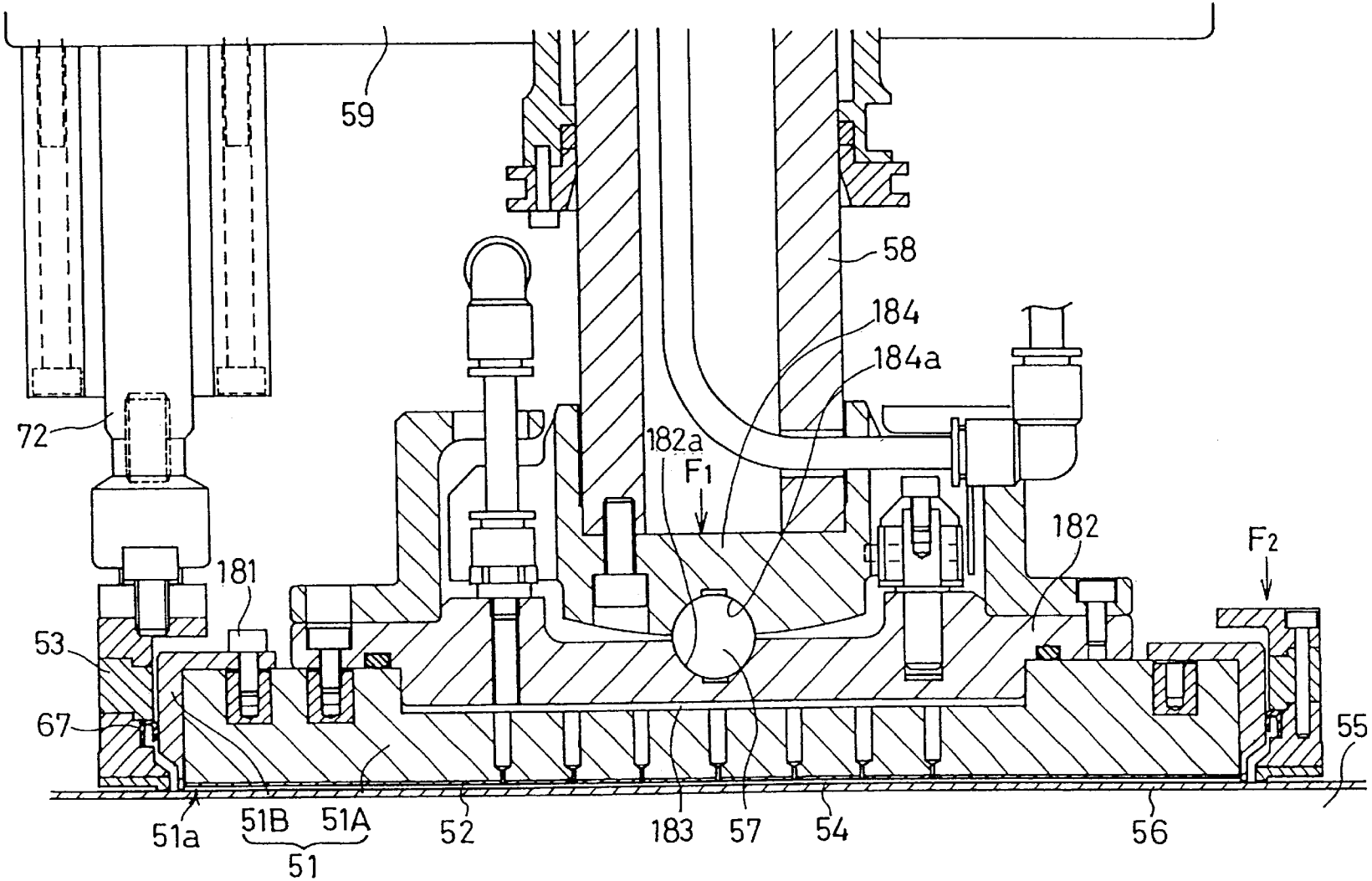
FIG. 14 is a cross-sectional view showing a main part of a polishing apparatus which has been proposed by the applicant of the present invention.

Further, in the polishing apparatus shown in FIG. 14, leaf spring for preventing the top ring from being tilted excessively is disposed between the presser ring and the top ring. However, in the illustrated embodiment of the present invention, since the chance of a direct contact of the presser ring and the top ring is reduced and the chance of excessive tilting of the top ring is reduced, it is unnecessary to provide the leaf spring. Since this leaf spring has been treated as expendable, the cost of expendables is reduced.

Figure 4:
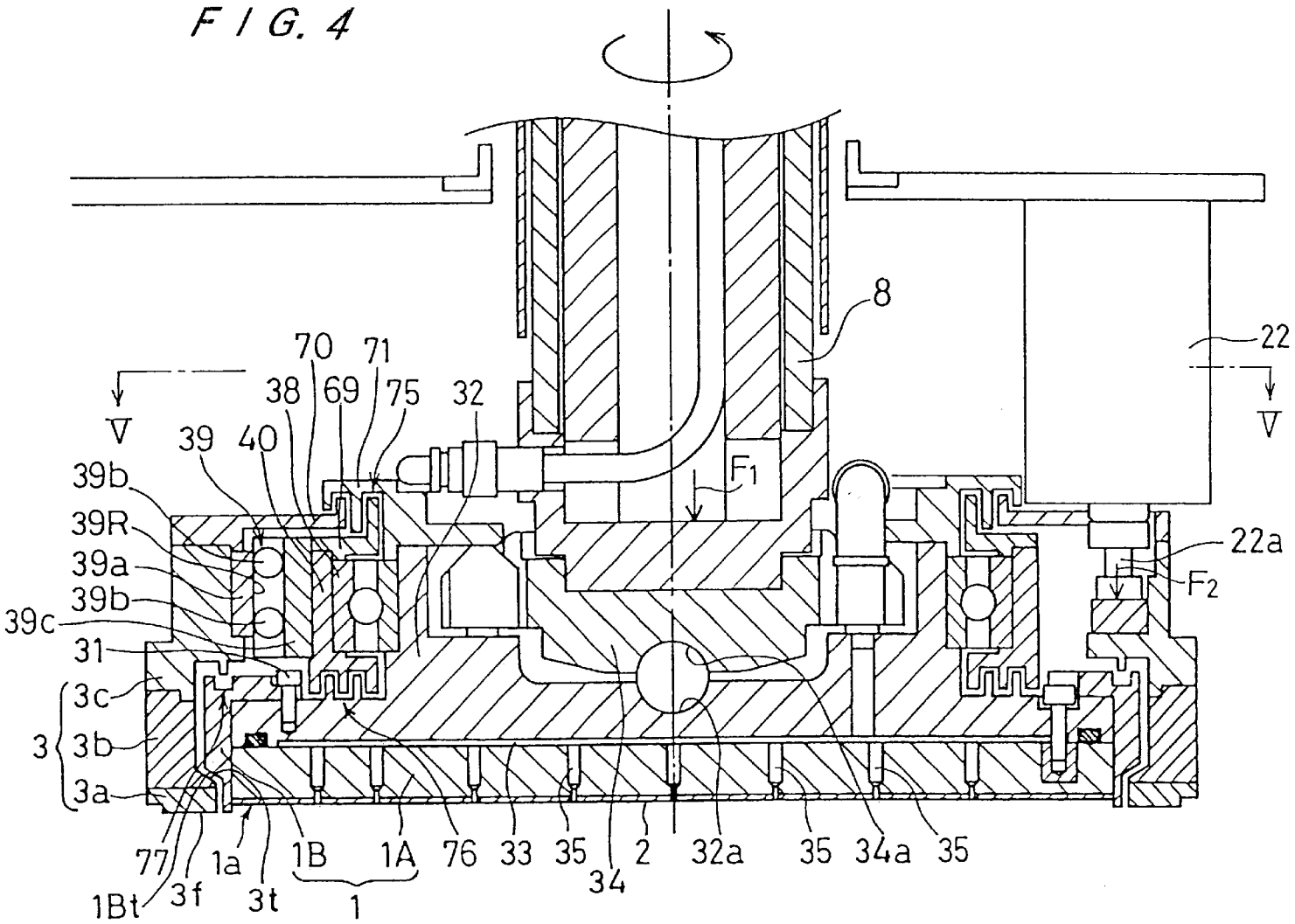
FIG. 4 is an enlarged fragmentary cross-sectional view of a polishing apparatus according to a second embodiment of the present invention.
Figure 5:
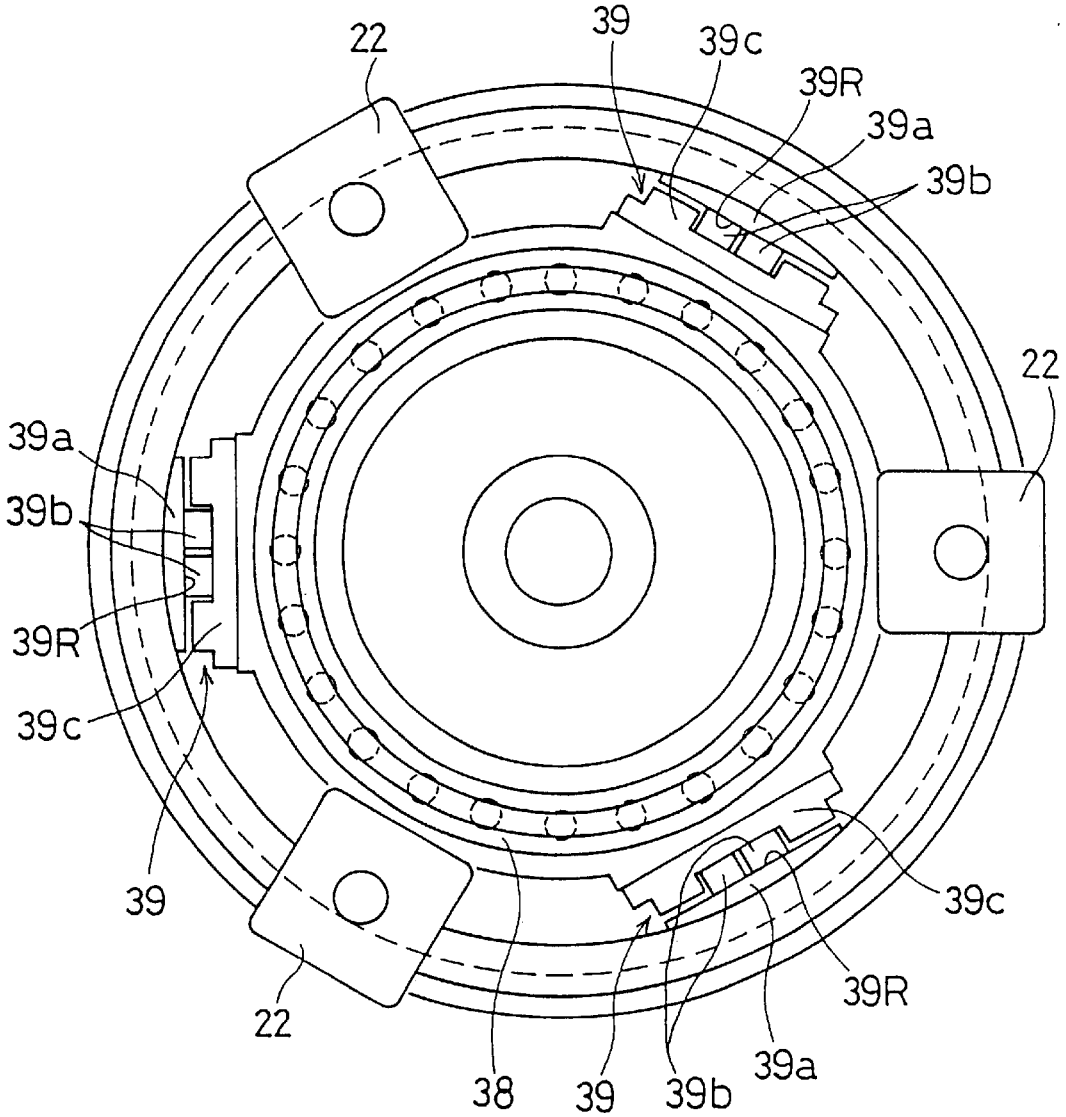
FIG. 5 is a view as viewed from line V—V of FIG. 4.

FIGS. 4 and 5 are views showing the second embodiment of the present invention. In the second embodiment, parts or components which have the same function as the first embodiment are denoted by the same reference numerals, and explanation thereof is omitted.

In this embodiment, the rotation support bearing function and the vertical movement support bearing function of the presser ring support bearing 37 in the first embodiment are assigned to two discrete bearings 38 and 39. That is, a bearing receiving ring 40 is provided outwardly of the attachment flange 32 with rotation support bearing 38 interposed therebetween. Vertical movement support bearings 39 are disposed between the bearing receiving ring 40 and the presser ring 3. The rotation support bearing 38 comprises a normal radial bearing. As shown in FIGS. 4 and 5, the vertical movement support bearings 39 are disposed circumferentially at three positions, and each of the vertical movement support bearings 39 comprises a plate member 39*a* fixed to the presser ring 3 and having a bearing rolling surface 39R, four short column rollers 39*b* disposed in two rows and two columns, and a bearing case 39*c* for accommodating the rollers 39*b*. The bearing case 39*c* is fixed to the bearing receiving ring 40 to which a bearing retainer 69 is fixed.

A presser ring stopper 70 is fixed to the upper end of the presser ring 3, and a cover 71 is fixed to the upper end of the attachment flange 32. Three labyrinths 75, 76 and 77 are formed so as to enclose the rotation support bearing 38 and the vertical movement support bearing 39. That is, the labyrinth 75 is formed between the bearing retainer 69, the presser ring stopper 70 and the cover 71, the labyrinth 76 is formed between the bearing receiving ring 40 and the attachment flange 32, and the labyrinth 77 is formed between the third presser ring 3*c* of the presser ring 3 and the retainer 1B.

According to the present embodiment shown in FIGS. 4 and 5, the support position by the bearing is closer to the polishing surface than the structure of the first embodiment. As a result, it is possible to support the presser ring 3 more stably.

Further, in the first embodiment, since two movements are received by a single bearing, the ball contacts the ball rolling surface so that the ball moves simultaneously in two directions. Therefore, a large friction is generated in the contact surface depending on hardness of the rolling surface, thus shortening the life of the bearing. In this embodiment, the relative rotation between the top ring 1 and the presser ring 3 is supported by the rotation support bearing 38, and the vertical movement of the presser ring 3 relative to the top ring 1 is supported by the vertical movement support bearing 39. That is, it is possible to give one directional motion to one bearing and to improve the life of the bearing by allowing the rolling surface to make a line-contact.

In case of using the above structure, it is undesirable that foreign matter including liquid such as water or abrasive liquid and solid such as ground-off particles enters the bearing installation part. Therefore, it is necessary to prevent the above liquid or solid from entering the bearing or area thereabout, and as such means, it is conceivable that a mechanical seal structure such as a contact type seal is provided near the bearing or a mechanism such as a labyrinth is provided near the bearing.

In case of sealing mechanically, a friction is generated at a contact area, and the sealing member may become expendable. Further, the friction generates foreign matter, and the frictional area may become a source for generating foreign matter. In contrast thereto, the labyrinth structure as shown in FIG. 4 is a noncontact type, and there is no fear of generating foreign matter. By arrangement of a plurality of the labyrinths 75, 76 and 77, it is possible to improve a function for preventing foreign matter from entering therethrough. Further, it is undesirable that foreign matter enters the polishing surface, and by using the labyrinth structure, it is possible to prevent foreign matter generated above the polishing surface from falling on the polishing surface. Other operation or effect in the second embodiment is the same as the first embodiment.

Figure 6:
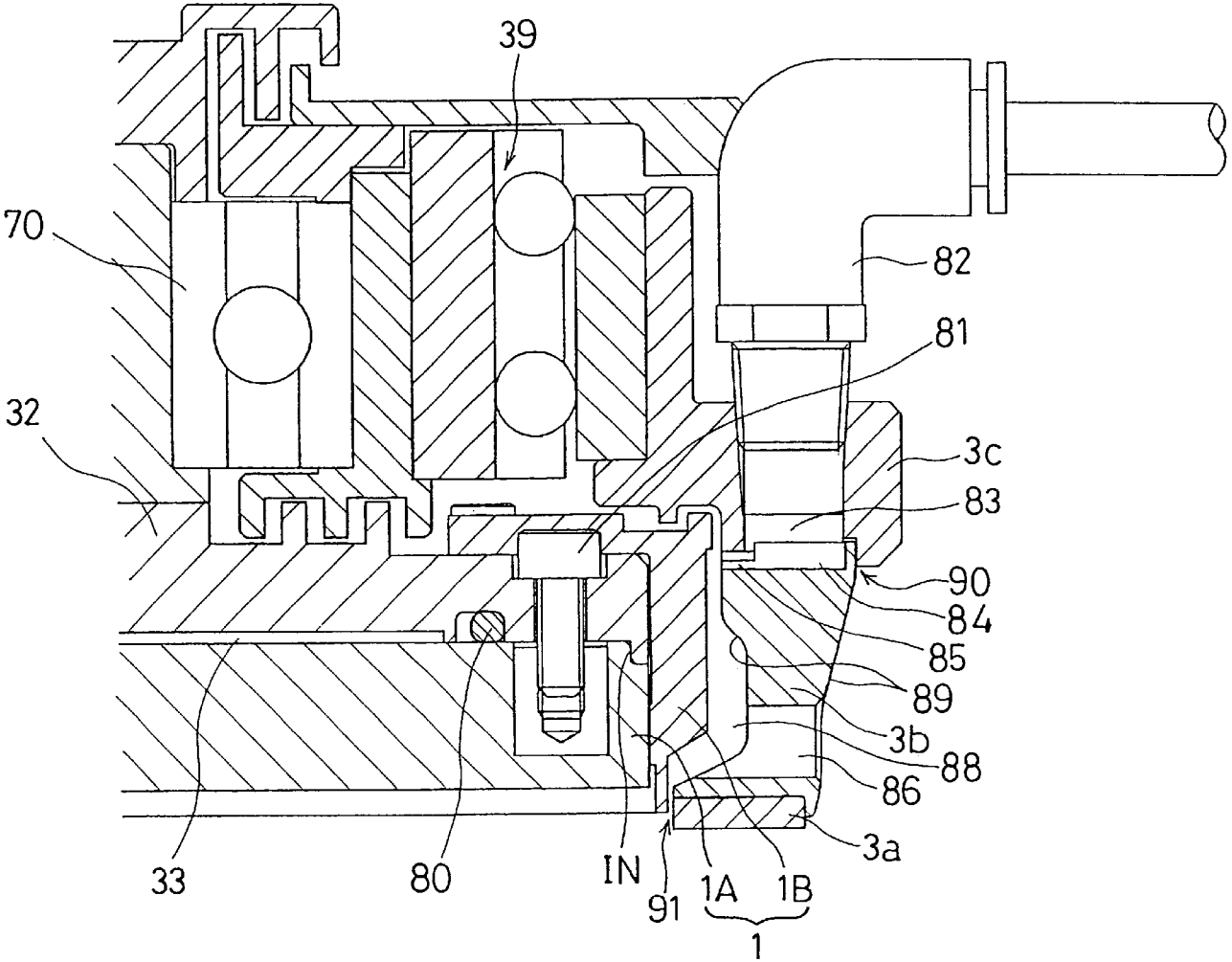
FIG. 6 is an enlarged fragmentary cross-sectional view of an improved structure of the polishing apparatus shown in FIGS. 1 through 5.

FIG. 6 is an enlarged fragmentary cross-sectional view showing an improved structure of the polishing apparatus shown in FIGS. 1 through 5. In an example shown in FIG. 6, the top ring body 1A has an upper outer circumferential end having a faucet joint portion, and the attachment flange 32 has a lower outer circumferential end having a faucet joint portion, and the top ring body 1A and the attachment flange 32 are fitted with each other to thereby be positioned with each other. Therefore, only by fitting of both members, the top ring body 1A and the attachment flange 32 are coaxially positioned, and the ease of assembly is improved. An O-ring 80 for sealing the space 33 formed between the top ring body 1A and the attachment flange 32 for supplying vacuum or compressed air therein is provided at the inside of the bolts 81 for fixing the attachment flange 32 and the top ring 1A to each other. Thus, it is unnecessary to provide a washer having a sealing function at an area of the bolt 81.

On the other hand, a cleaning liquid supply pipe 82 is fixed to the upper portion of the third presser ring member 3*c* of the presser ring 3, and the third presser ring member 3*c* has a cleaning liquid discharge port 83 at its lower end. An annular fluid passage 84 is formed at an upper end of the second presser ring member 3*b* for holding the first presser ring member 3*a*. The annular fluid passage 84 communicates with an inner circumferential surface of the second presser ring member 3*b* through a plurality of communicating holes 85 disposed circumferentially at certain intervals. A plurality of drain holes 86 disposed circumferentially at certain intervals are formed at a lower portion of the second presser ring member 3*b*. The second presser ring member 3*b* has an annular recess at an inner surface thereof, and hence a relatively large space 88 is formed between the retainer ring 1B and the presser ring 3. The second presser ring member 3*b* has inner and outer circumferential surfaces coated with a resin coating 89 of polytetrafluoroethlene.

In the presser ring 3 having the above structure, a slurry-like abrasive liquid which has entered between the guide ring 1B and the presser ring 3 is discharged from the space 88 to the outside through the drain holes 86. Therefore, the slurry-like abrasive liquid is prevented from entering the upper portion of the guide ring 1B.

Further, by supplying a cleaning liquid through the cleaning liquid supply pipe 82 properly, the cleaning liquid is supplied to the space 88 between the guide ring 1B and the presser ring 3 through the annular fluid passage 84 and the communicating holes 85. Thereafter, the cleaning liquid is discharged to the outside of the presser ring 3 through a passage comprising a gap 91 between the guide ring 1B and the presser ring 3 and passages comprising the drain holes 86, and thus the guide ring 1B and the presser ring 3 are cleaned. Since a clearance 90 is formed at a connecting portion located at outer peripheries of the second presser ring member 3*b* and the third presser ring member 3*c*, the cleaning liquid within the annular fluid passage 84 flows along the outer surface of the presser ring 3 through the clearance 90 to clean the outer surface of the presser ring 3. Further, since the resin coating 89 is applied to the inner and outer surfaces of the second presser ring member 3*b* of the presser ring 3, the slurry-like abrasive liquid is hardly attached thereto, and even if it is attached thereto, it is easily removed therefrom by supplying the cleaning liquid.

As described above, according to the present invention, since the presser ring is supported by the top ring 1 through the presser ring support bearing, the presser ring is highly rigidly, i.e. sufficiently reliably, supported. Further, since the presser ring is allowed to move vertically with respect to the top ring by the vertical movement support bearing function of the presser ring support bearing or the dedicated vertical movement support bearing, the presser ring is vertically moved under a small sliding resistance and in a smooth condition.

Further, since the presser ring is supported by the presser ring support bearing disposed coaxially with an axis of the top ring, the concentricity of the presser ring and the top ring can be ensured highly accurately. Thus, the gap between the presser ring and the top ring, and thus the gap between the inner circumferential edge of the presser ring and the outer circumferential edge of the semiconductor wafer held by the top ring can be kept constant in a full circumference thereof. Further, by allowing this gap to be kept constant, the gap can be set to a smaller value, and the performance of polishing is improved.

Further, according to the present invention, since the noncontact type labyrinth is provided at the passage through which foreign matter enters the bearing for supporting the presser ring, the foreign matter is prevented from entering the bearing, and particles are prevented from being generated thereat.

Figure 7:
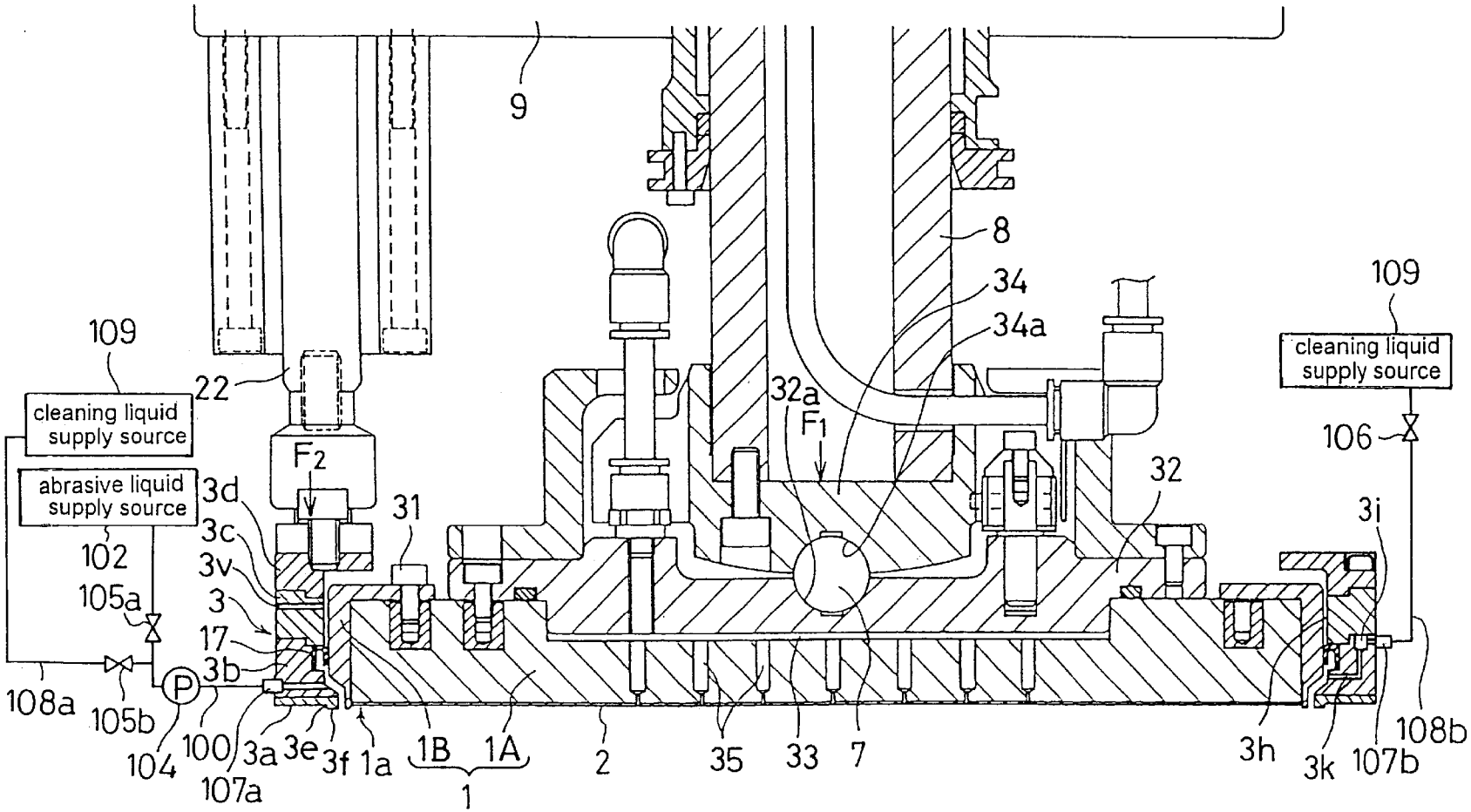
FIG. 7 is an enlarged fragmentary cross-sectional view of the polishing apparatus according to a third embodiment of the present invention.

Next, a polishing apparatus according to a third embodiment of the present invention will be described with reference to FIGS. 7 through 11. FIG. 7 is an enlarged cross-sectional view showing the top ring and the presser ring, FIG. 8A is an enlarged fragmentary cross-sectional view of FIG. 7, and FIG. 8B is a cross-sectional view taken along line VIII—VIII of FIG. 8A.

In FIG. 7, the reference numeral 1 represents a top ring 1 comprising a top ring body 1A and a retainer ring 1B detachably fixed to an outer circumferential edge of the top ring body 1A by bolts 31. A recess 1*a* for accommodating a semiconductor wafer 4 therein is defined jointly by a lower surface of the top ring body 1A and an inner circumferential surface of the retainer ring 1B. The upper surface of the semiconductor wafer 4 (see FIG. 1) is held by the lower surface of the top ring body 1A and an outer circumferential edge of the semiconductor wafer 4 is held by the inner circumferential surface of the retainer ring 1B. A presser ring 3 is vertically movably disposed around the retainer ring 1B. A leaf spring 17 having a U-shaped cross-section for preventing the top ring 1 from being tilted excessively is disposed between the top ring 1 and the presser ring 3.

An attachment flange 32 having a spherical concave surface 32*a* defined in an upper surface thereof is fixedly mounted on the top ring body 1A. A top ring shaft 8 is disposed above the top ring 1, and a drive shaft flange 34 having a spherical concave surface 34*a* is fixedly mounted on the lower end of the top ring shaft 8. A spherical bearing 7 is disposed between the spherical concave surfaces 32*a* and 34*a*. The top ring body 1A and the attachment flange 32 jointly define a space 33 therebetween which can be supplied with a vacuum, a compressed air, and a liquid such as water. The top ring body 1A has a plurality of vertical communication holes 35 defined therein which communicate with the space 33 and are open at the lower surface of the top ring body 1A. The elastic pad 2 also has a plurality of openings which are in communication with the respective communication holes 35. Therefore, the upper surface of the semiconductor wafer 4 (see FIG. 1) can be attracted to the top ring body 1A under vacuum developed in the space 33. Further, the upper surface of the semiconductor wafer 4 can be supplied with a liquid or a compressed air.

Figure 8A:
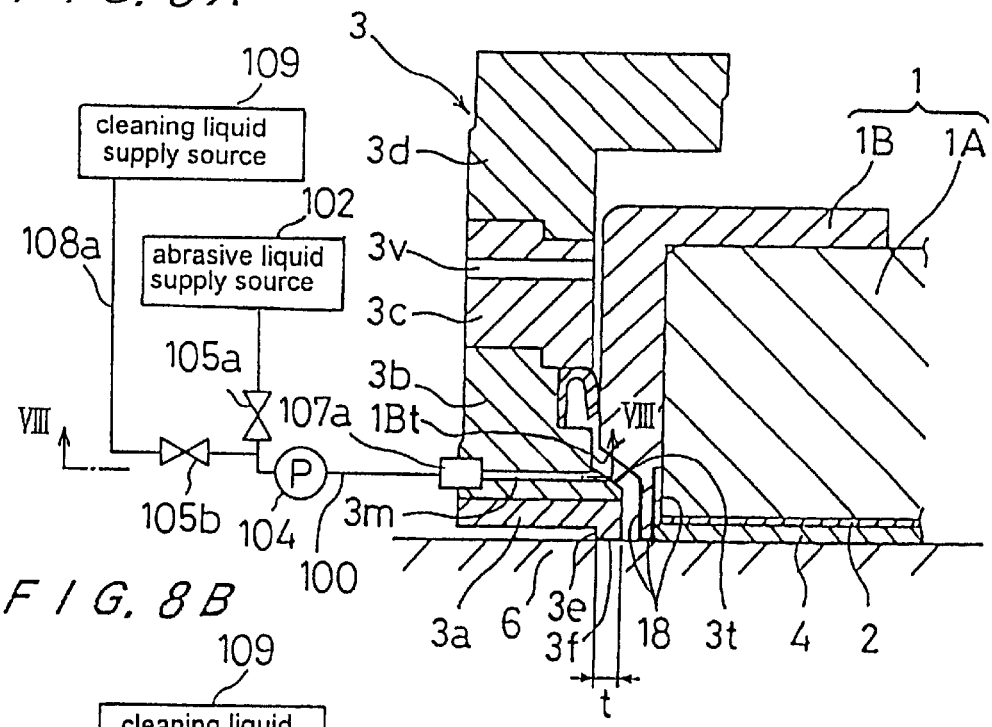
FIG. 8A is an enlarged fragmentary cross-sectional view of the polishing apparatus shown in FIG. 7.
Figure 8B:
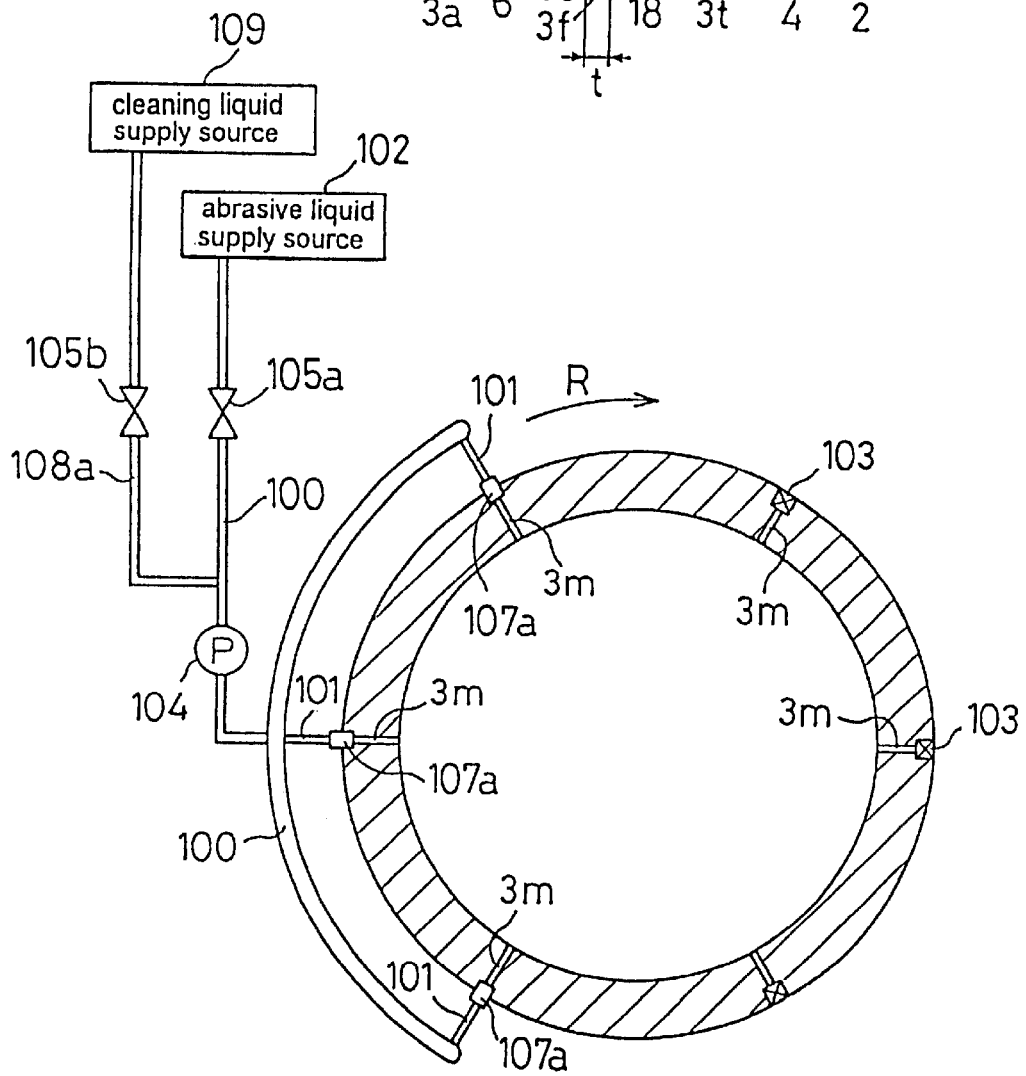
FIG. 8B is a cross-sectional view taken along line VIII—VIII of FIG. 8A.

As shown in FIGS. 7 and 8A, the presser ring 3 disposed around the top ring 1 comprises a vertical stack of presser ring members including a first presser ring member 3*a* made of alumina ceramics and disposed at a lowermost position, second and third presser ring members 3*b*, 3*c* made of stainless steel and disposed upwardly of the first presser ring member 3*a*, and a fourth presser ring member 3*d* made of stainless steel and disposed at an uppermost position. The second through fourth presser ring members 3*b*–3*d* are interconnected by bolts (not shown), and the first presser ring member 3*a* is fixed to the second presser ring member 3*b* by adhesion or the like. The first presser ring member 3*a* has an annular ridge 3*e* projecting downwardly from an inner peripheral portion thereof and having a pressing surface 3*f* on its lower end for pressing the polishing cloth 6. The pressing surface 3*f* has a radial width or thickness t in the range of from 2 to 6 mm.

The presser ring 3 has an upper end coupled to presser ring air cylinders 22. The presser ring air cylinders 22 are fixedly connected to the top ring head 9. A plurality of (e.g. three) the presser ring air cylinders 22 are disposed circumferentially at intervals. The retainer ring 1B is made of a metal such as stainless steel, and has on its outer circumference a tapered surface 1Bt that is inclined radially inwardly in a downward direction, so that the retainer ring 1B has a thin wall portion thinner than the portion of the retainer ring 1B above the lower end of the tapered surface 1Bt. The presser ring 3 has on its inner circumference a tapered surface 3*t* that is inclined radially inwardly in a downward direction complementarily to the tapered surface 1Bt of the retainer ring 1B to thereby allow the pressing surface 3*f* to be positioned as closely as possible to the outer circumferential edge of the semiconductor wafer 4 which is held by the top ring 1.

Because the distance between the inner circumferential edge of the pressing surface 3*f* and the outer circumferential edge of the semiconductor wafer 4 is minimized by the above structure of the retainer ring 1B and the presser ring 3, the presser ring 3 can press the polishing cloth 6 downwardly near the outer circumferential edge of the semiconductor wafer 4 for thereby preventing the outer circumferential edge of the semiconductor wafer 4 from being excessively polished. As shown by bold lines in FIG. 8A, the inner and outer lower surfaces and the bottom surface of the retainer ring 1B are coated with a resin coating 18. The resin coating 18 preferably comprises polyetherketone (PEEK), polytetrafluoroethylene, polyvinyl chloride, or the like. The resin coating 18 preferably has a thickness of 100 microns or less. The resin coating 18 on the metal retainer ring 1B is effective to prevent the semiconductor wafer 4 from being contaminated with metal.

In the illustrated embodiment, there is no means such as a key between the top ring 1 and the presser ring 3 for transmitting the rotation of the top ring 1 to the presser ring 3. Therefore, while the top ring 1 rotates about the axis of the top ring shaft 8 during operation of the polishing apparatus, the presser ring 3 is nonrotable about its own axis. Since the rotation of the top ring 1 is not transmitted to the presser ring 3, the load on the top ring shaft 8 when it rotates is relatively small. The polishing apparatus is relatively simple in structure because the presser ring 3 is directly operated by the presser ring air cylinders 22 fixedly mounted on the top ring head 9.

As shown in FIGS. 7 and 8A and 8B, a plurality of (e.g. six) abrasive liquid supply holes 3*m* which pass through the wall of the second presser ring member 3*b* are formed circumferentially at intervals in the second presser ring member 3*b* of the presser ring 3. As shown in FIG. 8B, branch pipes 101 branched from an abrasive liquid supply tube 100 are connected through connectors 107*a* to respective openings of the abrasive liquid supply holes 3*m* which are located at the upstream side of the rotational direction R of the turntable 5, among the abrasive liquid supply holes 3*m*. The abrasive liquid supply tube 100 is connected to an abrasive liquid supply source 102. Other openings of the abrasive liquid supply holes 3*m* are closed by respective plugs 103. A pump 104 for controlling the flow rate of the abrasive liquid, and a valve 105*a* located at the upstream side of the pump 104 for allowing or stopping the supply of the abrasive liquid are provided in the abrasive liquid supply tube 100. The abrasive liquid supply holes 3*m*, the connectors 107*a*, the branch pipes 101, the abrasive liquid supply tube 100, the pump 104 and the abrasive liquid supply source 102 constitute an abrasive liquid supply means or device which can supply the abrasive liquid to the inside of the presser ring 3. Since the presser ring 3 is nonrotatable about its own axis, the abrasive liquid can be supplied to the abrasive liquid supply holes 3*m* from the abrasive liquid supply source 102 without providing a rotary joint or the like.

By supplying the abrasive liquid to the inside of the presser ring 3 from the abrasive liquid supply means, even if inflow of the slurry-like abrasive liquid to the inside of the presser ring 3 is interrupted by the presser ring 3 during polishing of the semiconductor wafer 4, insufficient supply of the abrasive liquid which is used for polishing can be prevented. Therefore, the workpiece can be smoothly polished with abrasive liquid sufficient in quantity. A cleaning liquid supply tube 108*a* is connected to the abrasive liquid supply tube 100 between the valve 105*a* and the pump 104, and is connected to the cleaning liquid supply source 109. This structure constitutes a cleaning means or device. A valve 105*b* is provided in the cleaning liquid supply tube 108*a*. Thus, when the valve 105*b* is opened and the cleaning liquid is supplied from the cleaning means to the abrasive liquid supply tube 100 and the abrasive liquid supply holes 3*m* of the abrasive liquid supply means, the abrasive liquid attached to the inside of the abrasive liquid supply tube 100 and the abrasive liquid supply holes 3*m* can be washed away.

Figure 9A:
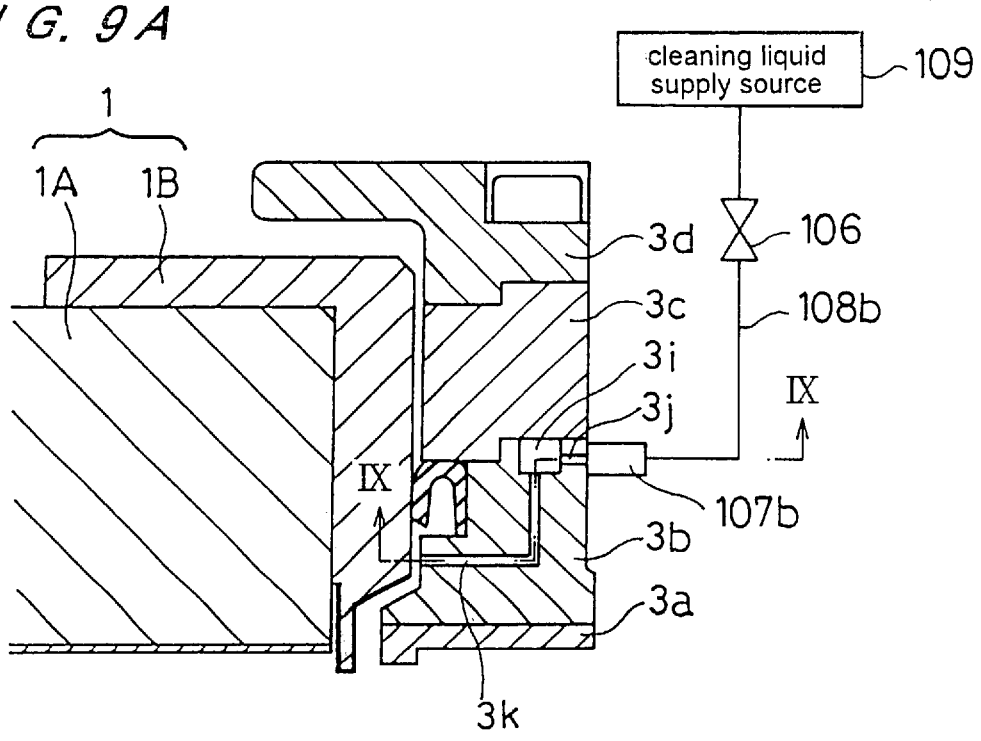
FIG. 9A is an enlarged fragmentary cross-sectional view of the polishing apparatus shown in FIG. 7.
Figure 9B:
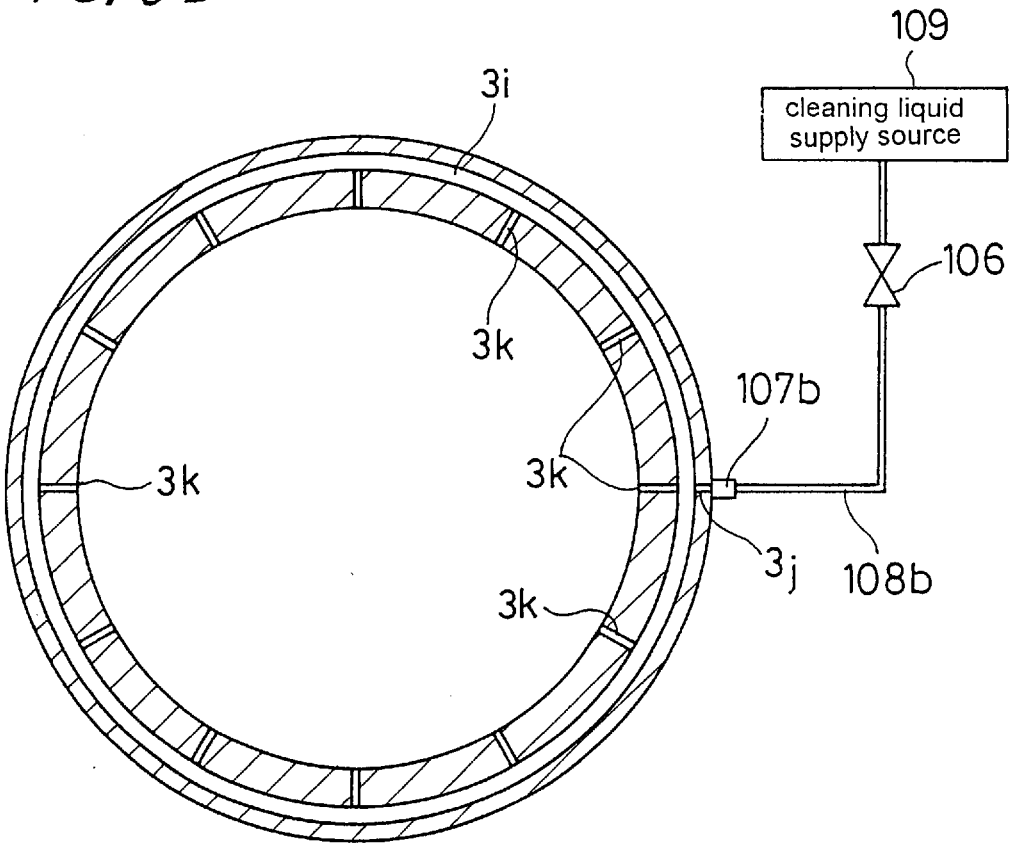
FIG. 9B is a cross-sectional view taken along line IX—IX of FIG. 9A.

As shown in FIG. 9A (an enlarged fragmentary cross-sectional view of FIG. 7) and FIG. 9B (a cross-sectional view taken along line IX—IX of FIG. 9A), between the second presser ring member 3*b* and the third presser ring member 3*c* of the presser ring 3, there is provided a cleaning liquid passage 3*i* comprising a circular groove formed fully circumferentially in the upper surface of the second presser ring member 3*b*. The second presser ring member 3*b* has a cleaning liquid supply hole 3*j* which is open at the outer peripheral surface thereof and communicates with the cleaning liquid passage 3*i*, and a plurality of cleaning liquid discharge holes 3*k* which are open at the inner peripheral surface thereof and communicate with the cleaning liquid passage 3*i*. A cleaning liquid supply tube 108*b* is connected to the opening of the cleaning liquid supply hole 3*j* through a connector 107*b*. The cleaning liquid supply tube 108*b* is connected to the cleaning liquid supply source 109 through a valve 106 in the same manner as the cleaning liquid supply tube 108*a*. The cleaning liquid discharge holes 3*k*, the cleaning liquid passage 3*i*, the cleaning liquid supply hole 3*j*, the connector 107*b*, the cleaning liquid supply tube 108*b* and the cleaning liquid supply source 109 jointly constitute a cleaning liquid supply means or device. Since the presser ring 3 is nonrotatable, the supply of the cleaning liquid from the cleaning liquid supply source 109 to the cleaning liquid passage 3*i* and the discharge of the cleaning liquid through the cleaning liquid discharge holes 3*k* can be easily performed without providing a rotary joint or than like.

By supplying the cleaning liquid properly to a gap between the presser ring 3 and the retainer ring 1B of the top ring 1 from the cleaning liquid supply means, the slurry-like abrasive liquid which has entered the gap can be washed away with the cleaning liquid. Therefore, the abrasive liquid does not adhere in the gap between the presser ring 3 and the retainer ring 1B of the top ring 1, and the presser ring 3 can be moved smoothly.

Further, a plurality of vent holes 3*v* are formed in the presser ring 3 to discharge gas such as air trapped in the gap between the presser ring 3 and the retainer ring 1B of the top ring 1 (see FIG. 8A). Therefore, gas is not trapped in the gap between the presser ring 3 and the retainer 1B of the top ring 1, and the vertical motion of the presser ring 3 can be made smoothly. Thus, when polishing is started, the presser ring 3 can contact the polishing cloth 6 in exact timing and can press the polishing cloth 6 at a desired value.

Figure 10A:
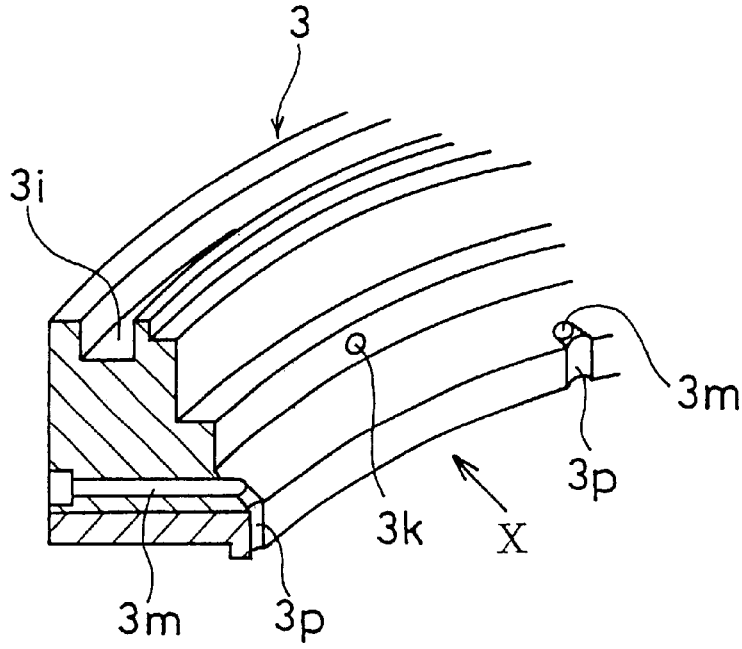
FIG. 10A is a perspective view of a part of a presser ring.
Figure 10B:
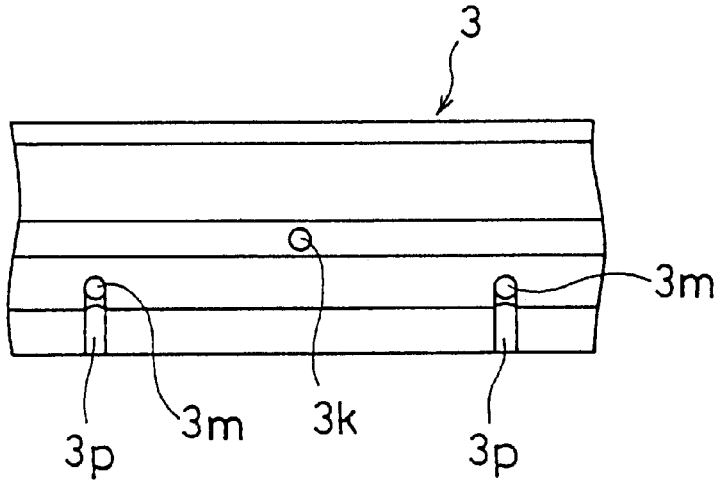
FIG. 10B is a view as viewed from arrow X of FIG. 10A.

FIG. 10A is a perspective view showing a part of the presser ring, and FIG. 10B is a view as viewed from arrow X of FIG. 10A. As shown in FIGS. 10A and 10B, the presser ring 3 has the abrasive liquid supply holes 3*m*, abrasive liquid supply grooves 3*p* extending downwardly from the openings of the abrasive liquid supply holes 3*m*, the cleaning liquid discharge holes 3*k* and the cleaning liquid supply passage 3*i*. The abrasive liquid supplied to the abrasive liquid supply holes 3*m* flows downwardly along the abrasive liquid guide grooves 3*p* and reaches the polishing cloth 6.

Figure 11A:
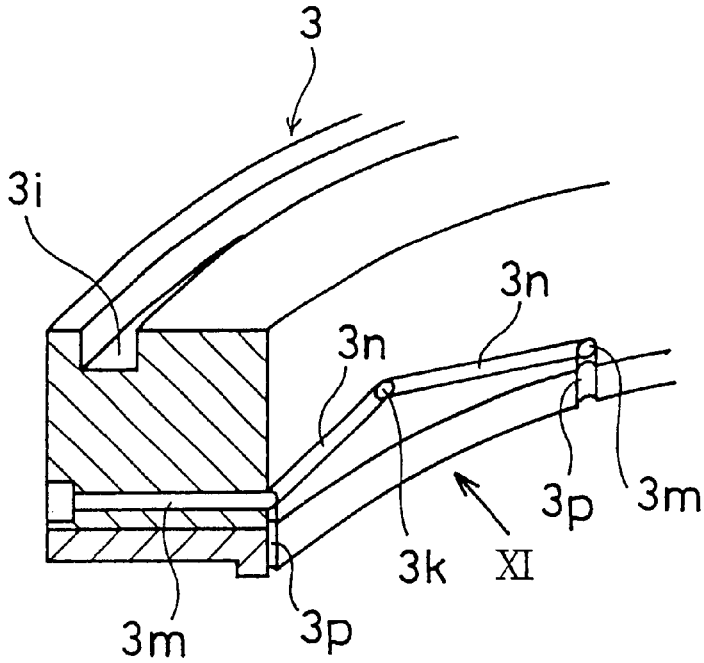
FIG. 11A is a perspective view of a part of a presser ring.
Figure 11B:
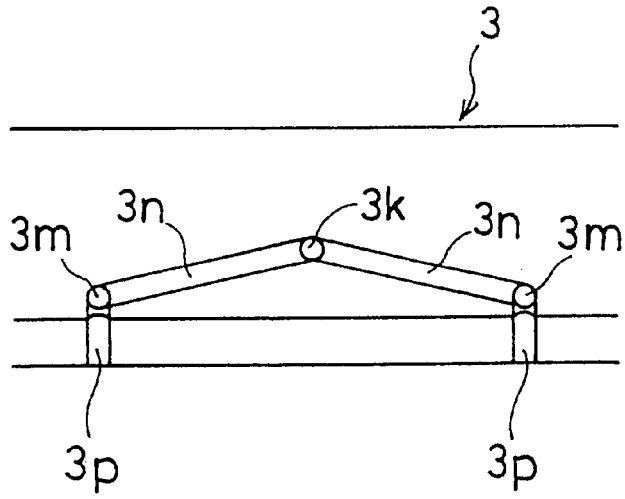
FIG. 11B is a view as viewed from arrow XI of FIG. 11A.
Figure 12:
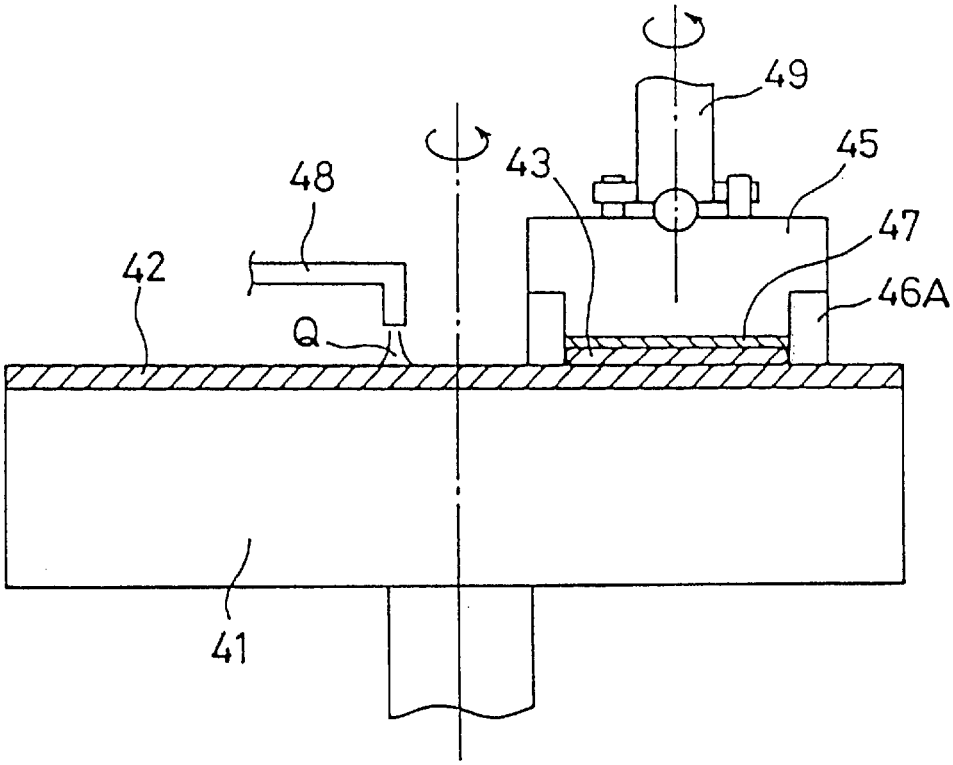
FIG. 12 is a schematic cross-sectional view of a conventional polishing apparatus.
Figure 13:
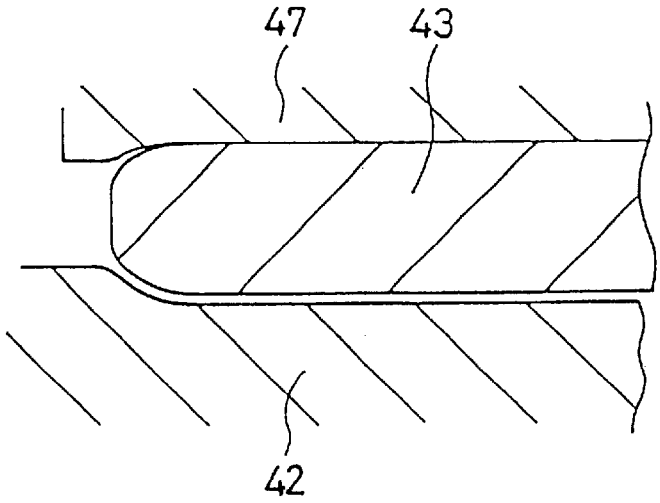
FIG. 13 is an enlarged fragmentary cross-sectional view showing the state of a semiconductor wafer, a polishing cloth and an elastic pad in the conventional polishing apparatus.

FIGS. 11A and 11B are views showing another embodiment of the presser ring, and FIG. 11A is a perspective view showing a part of the presser ring and FIG. 11B is a view as viewed from arrow XI of FIG. 11A. The presser ring 3 has a single continuous inner circumferential surface without any step. The presser ring 3 has the abrasive liquid supply holes 3*m*, the cleaning liquid discharge holes 3*k* and the cleaning liquid passage 3*i* in the same manner as the embodiment shown in FIGS. 10A and 10B. The presser ring 3 has on its inner circumferential surface cleaning liquid guide grooves 3*n* each for connecting the opening end of the cleaning liquid discharge hole 3*k* and the opening end of the abrasive liquid supply hole 3*m*, and abrasive liquid guide grooves 3*p* extending downwardly from the opening ends of the abrasive liquid supply holes 3*m*. Thus, the abrasive liquid supplied to the abrasive liquid supply holes 3*m* flows downwardly along the abrasive liquid guide grooves 3*p* and reaches the polishing cloth 6. Further, the abrasive liquid attached to the abrasive liquid supply holes 3*m* and the abrasive liquid guide grooves 3*p* is removed by the cleaning liquid which is supplied from the cleaning means to the abrasive liquid supply holes 3*m* and flows along the abrasive liquid guide grooves 3*p*, and the cleaning liquid which is discharged from the cleaning liquid discharge holes 3*k* by the cleaning liquid supply means and flows through the cleaning liquid guide grooves 3*n* and the abrasive liquid supply holes 3*m* and then along the abrasive liquid guide grooves 3*p*.

In the polishing apparatus having the above structure, the semiconductor wafer 4 is held on the lower surface of the top ring 1, and the top ring air cylinder 10 is operated to press the top ring 1 downwardly toward the turntable 5 for thereby pressing the semiconductor wafer 4 against the polishing cloth 6 on the turntable which is rotating. On the other hand, the abrasive liquid Q is supplied from the abrasive liquid supply nozzle 25 onto the polishing cloth 6 and is retained thereon. At the same time, the abrasive liquid is supplied to the inside of the presser ring 3 by the abrasive liquid supply means, and the surface to be polished (the lower surface) of the semiconductor wafer 4 is polished by the sufficient amount of abrasive liquid Q which is present between the lower surface of the semiconductor wafer 4 and the polishing cloth 6.

Depending on the force applied from the top ring air cylinder 10 to the top ring 1, the pressing force of the presser ring 3 for pressing the polishing cloth 6 by the presser ring air cylinders 22 is adjusted properly for thereby polishing the semiconductor wafer 4. While the semiconductor wafer 4 is being polished, the pressing force $F_1$ which is applied by the top ring 1 to press the semiconductor wafer 4 against the polishing cloth 6 can be changed by the regulator R1, and the pressing force $F_2$ which is applied by the presser ring 3 to press the polishing cloth 6 can be changed by the regulator R2 (see FIG. 1). Therefore, during the polishing process, the pressing force $F_2$ applied by the presser ring 3 to press the polishing cloth 6 can be changed depending on the pressing force $F_1$ applied by the top ring 1 to press the semiconductor wafer 4 against the polishing cloth 6. By adjusting the pressing force $F_2$ with respect to the pressing force $F_1$, the distribution of polishing pressures is made continuous and uniform from the center of the semiconductor wafer 4 to its peripheral edge and further to the outer circumferential edge of the presser ring 3 disposed around the semiconductor wafer 4. Consequently, the peripheral portion of the semiconductor wafer 4 is prevented from being polished excessively or insufficiently.

If a greater or smaller thickness of material is to be removed from the peripheral portion of the semiconductor wafer 4 than from the inner region of the semiconductor wafer 4, then the pressing force $F_2$ applied by the presser ring 3 is selected to be of a suitable value based on the pressing force $F_1$ applied by the top ring 1 to intentionally increase or reduce the amount of a material removed from the peripheral portion of the semiconductor wafer 4.

After completing of polishing the semiconductor wafer 4 and before polishing of the subsequent semiconductor wafer, the cleaning liquid is supplied to the gap between the presser ring 3 and the top ring 1, and the slurry-like abrasive liquid which has entered the gap is washed away with the cleaning liquid. At the same time, by supplying the cleaning liquid to the abrasive liquid supply tube 100 and the abrasive liquid supply holes 3*m* of the abrasive liquid supply means with the cleaning means, the abrasive liquid which has adhered to the abrasive liquid supply tube 100 and the abrasive liquid supply holes 3*m* is washed away.

According to this embodiment, since means for supplying the abrasive liquid to the inside of the presser ring 3 is provided, even if the supply of the slurry-like abrasive liquid to the inside of the presser ring 3 is interrupted by the presser ring 3 during polishing of the semiconductor wafer 4, insufficient supply of the abrasive liquid which is used for polishing can be prevented by supplying the abrasive liquid to the inside of the presser ring 3 directly. Therefore, the workpiece can be smoothly polished with sufficient amount of the abrasive liquid. Further, in case of the semiconductor wafer 4 having a large diameter, the abrasive liquid can be sufficiently supplied in quantity.

Further, according to this embodiment, the retainer ring 1B and the presser ring 3 can be selected from optimum materials. Since the retainer ring 1B has an inner circumferential surface which contacts the semiconductor wafer 4 and the lower end which does not contact the polishing cloth due to the resin coating 18 or the like on the metal, a relatively soft surface can be selectly made. If hard material is used in the retainer ring 1B, the semiconductor wafer 4 is possibly damaged during polishing. Further, even when the retainer ring 1B and the presser ring 3 are brought into contact with each other, they contact with each other through the resin coating 18 without causing metal contact, and hence the relative motion (vertical motion and rotating motion) between the presser ring 3 and retainer ring 1B can be made smoothly.

Further, the first presser ring member 3*a* is held out of contact with the semiconductor wafer 4, but held in contact with the polishing cloth 6. Therefore, the first presser ring member 3*a* is made of a material which is hard and highly resistant to wear and has a low coefficient of friction, such as alumina ceramics. Specifically, the presser ring 3 should preferably be subject to minimum wear and small frictional resistance upon frictional contact with the polishing cloth 6. Furthermore, particles that are produced from the presser ring 3 when it is worn should not adversely affect semiconductor devices which are formed on the semiconductor wafer 4. Inasmuch as the first presser ring member 3*a* is held out of contact with the semiconductor wafer 4, the above requirements may be met if the first presser ring member 3*a* is made of alumina ceramics or the like. Alternatively, the presser ring 3 may be made of any of various other ceramic materials including silicon carbide (SiC), zirconia, or the like.

Although the presser ring 3 is nonrotatable about its own axis in this embodiment, the presser ring may be rotatable about its own axis and the abrasive liquid may be supplied to the inside of the presser ring through a rotary joint.

As described above, according to the present invention, inasmuch as means for supplying the abrasive liquid to the inside of the presser ring is provided, even if the supply of the slurry-like abrasive liquid to the inside of the presser ring is interrupted by the presser ring during polishing of the semiconductor wafer, insufficient supply of the abrasive liquid which is used for polishing can be prevented by supplying the abrasive liquid to the inside of the presser ring directly. Therefore, the workpiece can be smoothly polished under the sufficient amount of the abrasive liquid.

Industrial Applicability

The present invention relates to a polishing apparatus for polishing a workpiece such as a semiconductor wafer to a flat mirror finish, and can be utilized for manufacturing semiconductor devices.

What is claimed is:

1. A polishing apparatus comprising:

a turntable having a polishing cloth on an upper surface thereof;

a top ring to press under a certain pressing force a workpiece, to be positioned between said turntable and said top ring, toward said turntable to thus polish the workpiece;

a presser ring vertically movably provided around said top ring;

a bearing supporting said presser ring on said top ring; and a pressing device to press said presser ring against said polishing cloth under a variable pressing force.

2. An apparatus as claimed in claim 1, wherein said top ring has a recess for accommodating the workpiece.

3. An apparatus as claimed in claim 1, wherein said bearing comprises an integral bearing supporting said presser ring to enable relative rotation between said top ring and said presser ring, and also to enable vertical movement of said presser ring with respect to said top ring.

4. An apparatus as claimed in claim 1, wherein said bearing comprises a rotation support bearing supporting said presser ring to enable relative rotation between said top ring and said presser ring, and a vertical movement support bearing to enable vertical movement of said presser ring with respect to said top ring.

5. An apparatus as claimed in claim 1, further comprising a labyrinth to prevent foreign matter from entering said bearing.

6. An apparatus as claimed in claim 1, further comprising a cleaning liquid supply to supply a cleaning liquid to a gap between said presser ring and said top ring.

7. A polishing apparatus comprising:

a turntable having a polishing cloth on an upper surface thereof;

a top ring to press under a certain pressing force a workpiece, to be positioned between said turntable and said top ring, toward said turntable to thus polish the workpiece;

a presser ring vertically movably provided around said top ring;

a pressing device to press said presser ring against said polishing cloth under a variable pressing force; and an abrasive liquid supply to supply abrasive liquid inside of said presser ring, said abrasive liquid supply including a cleaning device to allow abrasive liquid flowing through said abrasive liquid supply to be washed away.

8. An apparatus as claimed in claim 7, wherein said top ring has a recess for accommodating the workpiece.

9. An apparatus as claimed in claim 7, wherein said abrasive liquid supply comprises an abrasive liquid supply hole passing through a wall of said presser ring, an abrasive liquid supply tube connected to said abrasive liquid supply hole, and an abrasive liquid supply source connected to said abrasive liquid supply tube.

10. An apparatus as claimed in claim 9, further comprising a cleaning liquid supply device to supply cleaning liquid to a gap between said top ring and said presser ring, said cleaning liquid supply device including a cleaning liquid supply hole located above abrasive liquid supply hole of said abrasive liquid supply.

11. An apparatus as claimed in claim 7, further comprising a cleaning liquid supply device to supply cleaning liquid to a gap between said top ring and said presser ring.

12. A polishing apparatus comprising:

a turntable having a polishing cloth on an upper surface thereof;

a top ring to press under a certain pressing force a workpiece, to be positioned between said turntable and said top ring, toward said turntable to thus polish the workpiece;

a presser ring vertically movably provided around said top ring;

a pressing device to press said presser ring against said polishing cloth under a variable pressing force; and an abrasive liquid supply to supply abrasive liquid inside of said presser ring, said abrasive liquid supply comprising an abrasive liquid supply hole passing through a wall of said presser ring, an abrasive liquid supply tube connected to said abrasive liquid supply hole, and an abrasive liquid supply source connected to said abrasive liquid supply tube.

13. An apparatus as claimed in claim 12, wherein said top ring has a recess for accommodating the workpiece.

14. An apparatus as claimed in claim 12, further comprising a cleaning liquid supply device to supply cleaning liquid to a gap between said top ring and said presser ring, said cleaning liquid supply device including a cleaning liquid supply hole located above abrasive liquid supply hole of said abrasive liquid supply.

15. An apparatus as claimed in claim 12, wherein said top ring has a recess for accommodating the workpiece.

16. A polishing apparatus comprising:

a turntable having a polishing cloth on an upper surface thereof;

a top ring to press under a certain pressing force a workpiece, to be positioned between said turntable and said top ring, toward said turntable to thus polish the workpiece;

a presser ring vertically movably provided around said top ring;

a pressing device to press said presser ring against said polishing cloth under a variable pressing force;

an abrasive liquid supply to supply abrasive liquid inside of said presser ring; and a cleaning liquid supply device to supply cleaning liquid to a gap between said top ring and said presser ring.

17. A polishing apparatus comprising:

a table having a polishing surface thereon;

a top ring to press under a certain pressing force a workpiece, to be positioned between said table and said top ring, toward said table to thus polish the workpiece;

a presser ring vertically movably provided around said top ring;

a bearing supporting said presser ring on said top ring; and a pressing device to press said presser ring against said polishing surface under a variable pressing force.

18. A polishing apparatus comprising:

a table having a polishing surface thereon;

a top ring to press under a certain pressing force a workpiece, to be positioned between said table and said top ring, toward said table to thus polish the workpiece;

a presser ring vertically movably provided around said top ring;

a pressing device to press said presser ring against said polishing surface under a variable pressing force; and an abrasive liquid supply to supply abrasive liquid inside of said presser ring, said abrasive liquid supply including a cleaning device to allow abrasive liquid flowing through said abrasive liquid supply to be washed away.

19. A polishing apparatus comprising:

a table having a polishing surface thereon;

a top ring to press under a certain pressing force a workpiece, to be positioned between said table and said top ring, toward said table to thus polish the workpiece;

a presser ring vertically movably provided around said top ring;

a pressing device to press said presser ring against said polishing surface under a variable pressing force; and an abrasive liquid supply to supply abrasive liquid inside of said presser ring, said abrasive liquid supply comprising an abrasive liquid supply hole passing through a wall of said presser ring, an abrasive liquid supply tube connected to said abrasive liquid supply hole, and an abrasive liquid supply source connected to said abrasive liquid supply tube.

20. A polishing apparatus comprising:

a table having a polishing surface thereon;

a top ring to press under a certain pressing force a workpiece, to be positioned between said table and said top ring, toward said table to thus polish the workpiece;

a presser ring vertically movably provided around said top ring;

a pressing device to press said presser ring against said polishing surface under a variable pressing force;

an abrasive liquid supply to supply abrasive liquid inside of said presser ring; and a cleaning liquid supply device to supply cleaning liquid to a gap between said top ring and said presser ring.

* * * * *